US005278611A

United States Patent [19]

Ito et al.

[11] Patent Number: 5,278,611

[45] Date of Patent: Jan. 11, 1994

[54] IMAGE DUPLICATING APPARATUS FOR USE WITH AN EXTERNAL DATA STORAGE MEDIUM

[75] Inventors: Masazumi Ito; Kimihiko Higashio; Kadotaro Nishimori; Yoichi Kawabuchi, all of Osaka, Japan

[73] Assignee: Minolta Camera Kabushiki Kaisha, Osaka, Japan

[21] Appl. No.: 950,723

[22] Filed: Sep. 24, 1992

Related U.S. Application Data

[63] Continuation of Ser. No. 426,092, Nov. 24, 1989, abandoned, which is a continuation-in-part of Ser. No. 265,712, Nov. 1, 1988, abandoned.

[30] Foreign Application Priority Data

| | | | |
|---|---|---|---|
| Nov. 2, 1987 | [JP] | Japan | 62-278061 |
| Nov. 2, 1987 | [JP] | Japan | 62-278062 |
| Nov. 2, 1987 | [JP] | Japan | 62-278063 |
| Nov. 2, 1987 | [JP] | Japan | 62-278064 |
| Nov. 2, 1987 | [JP] | Japan | 62-278065 |
| Aug. 24, 1988 | [JP] | Japan | 63-209968 |
| Oct. 27, 1988 | [JP] | Japan | 63-271675 |

[51] Int. Cl.[5] ..... G03G 21/00

[52] U.S. Cl. ..... 355/202; 355/209

[58] Field of Search ..... 355/200, 202, 203, 204, 355/206, 208, 209

[56] References Cited

U.S. PATENT DOCUMENTS

| | | | |
|---|---|---|---|
| 4,501,485 | 2/1985 | Tsudaka | 355/201 |
| 4,764,789 | 8/1988 | Iwaki et al. | 355/209 |
| 4,780,806 | 10/1988 | Wada et al. | 355/200 X |
| 4,821,107 | 4/1989 | Naito et al. | 355/202 X |
| 4,990,954 | 2/1991 | Higashio et al. | 355/200 |
| 5,027,153 | 6/1991 | Komiya | 355/200 |
| 5,030,990 | 7/1991 | Iwaki et al. | 355/204 |

*Primary Examiner*—Fred L. Braun

*Attorney, Agent, or Firm*—Willian Brinks Hofer Gilson & Lione

[57] ABSTRACT

An image duplicating apparatus of the type having an IC-card controlled mode of operation in which are to be established standard conditions for copying operation when predetermined initial requirements are satisfied in the absence of an IC card set in the apparatus, and IC-card optional conditions for copying operation when the predetermined requirements are satisfied in the presence of an IC card set in the apparatus. The apparatus includes a control for selecting duplicating conditions within the apparatus and a memory for storing data representative of the selected duplicating conditions in responses to a first state in which the IC-card is not set in the apparatus, and for storing data fetched from the IC-card in response to a second state when the IC-card is set in the apparatus. The control is responsive to transition from one state to the other for establishing either the standard conditions or the optional conditions for a copying operation.

20 Claims, 21 Drawing Sheets

A03
ANY KEY 'ON'
B01
NO
YES
START TIMER 'TAC'
B02
'TAC' TIMED UP
B03
NO
YES
B04
ALL-CLEAR KEY 'ON'
NO
YES
B05
IC CARD LOADED
YES
NO
B06
ESTABLISH STANDARD CONDITIONS
B07
ESTABLISH IC-CARD OPTIONAL CONDITIONS
B08
NOUT >99
NO
YES
B09
FOQ ← 1
B10
ESTABLISH CONDITIONS FOR UNINTERRUPTED PRODUCTION OF MORE THAN 99 OUTPUTS
RETURN

A05

IC CARD LOADED
D01
NO
D2
YES
INTERRUPT MODE REQUESTED
D02
NO
YES
COPYING IN PROGRESS
D03
NO
YES
D04
INTERRUPT
D06
STORE CARD OPTIONAL CONDITIONS
D05
STORE DATA FOR INT'D OPERATION
COPYING IN PROGRESS
D07
NO
D1
YES
FEO ← 1
D08
D2

D2

CYCLE OF OPERATION OVER
D17
NO
YES
FEO = 1
D18
NO
YES
FEO ← 0
D19
DATA IN REMAINING PRINT Q'TY AREA
D20
YES
NO
D21
STORE PRINT Q'TY DATA FROM IC CARD
ESTABLISH IC CARD OPTIONAL CONDITIONS
D23
ESTABLISH IC CARD OPTIONAL CONDITIONS
D24
DISPLAY PRINT Q'TY
DISPLAY PRINT Q'TY
D22
D25
NOUT>99
NO
YES
D26
FOQ ← 1
D27
NOUT = 99Q + R
STORE 'Q', 'R'
DISPLAY '99'
D3

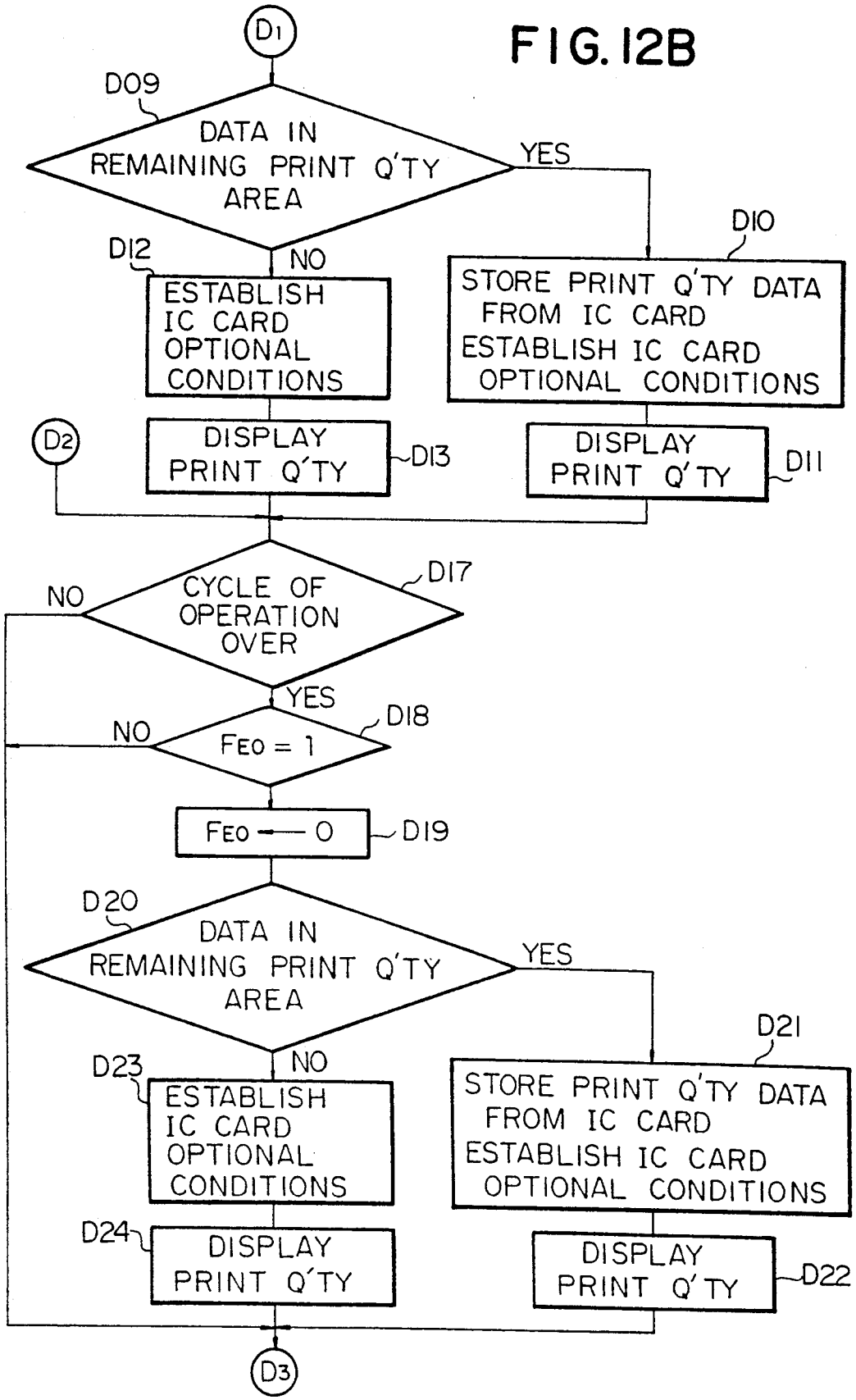
FIG. 12B
D1
D09
DATA IN REMAINING PRINT Q'TY AREA
YES
NO
D10
STORE PRINT Q'TY DATA FROM IC CARD ESTABLISH IC CARD OPTIONAL CONDITIONS
D12
ESTABLISH IC CARD OPTIONAL CONDITIONS
D2
DISPLAY PRINT Q'TY
D13
DISPLAY PRINT Q'TY
D11
D17
CYCLE OF OPERATION OVER
NO
YES
D18
NO
FEO = 1
FEO ← 0
D19
D20
DATA IN REMAINING PRINT Q'TY AREA
YES
NO
D21
D23
ESTABLISH IC CARD OPTIONAL CONDITIONS
STORE PRINT Q'TY DATA FROM IC CARD ESTABLISH IC CARD OPTIONAL CONDITIONS
D24
DISPLAY PRINT Q'TY
DISPLAY PRINT Q'TY
D22
D3

IMAGE DUPLICATING APPARATUS FOR USE WITH AN EXTERNAL DATA STORAGE MEDIUM

This application is a continuation of application Ser. No. 07/426,092, filed Oct. 24, 1989, now abandoned, which, in turn, is a continuation-in-part of Ser. No. 07/265,712 filed Nov. 1, 1988, now abandoned.

FIELD OF THE INVENTION

The present invention relates to an image duplicating apparatus of, particularly, the type having conditions for copying operation which can be selected and established in accordance with data supplied from an external data source in addition to the conditions which are to be selected within the apparatus per se. The external source of data for use with an image duplicating apparatus, which will be hereinafter referred to simply as duplicating apparatus, of such a type is, typically, an integrated-circuit card, which will be hereinafter referred to as IC card.

BACKGROUND OF THE INVENTION

An ordinary duplicating apparatus has various conditions for copying operation which are open to selection from a control panel forming part of the apparatus. Such conditions for copying operation of a duplicating apparatus typically include a magnification/reduction ratio for copying, the print density which is dictated by the optical exposure volume, the size of the print sheet or sheets to be used, and so forth. Any of these conditions for copying operation can be selected arbitrarily from a control panel forming part of the duplicating apparatus before each cycle of copying operation is to be started. A cycle of copying operation as herein referred to may consist of a single printing step to produce a single printed output or of a succession of printing steps to produce a plurality of printed outputs.

When a duplicating apparatus having such various conditions for copying operation is switched in by an operator depressing a power supply switch of the apparatus, predetermined conditions for copying operation are automatically established within the apparatus in accordance with prescribed default rules incorporated in the control system of the apparatus. These "initial" conditions for copying operation which are ordinarily selected are those which are likely to be most frequently used for document duplicating purposes by ordinary users. Typical of such most frequently used "standard" conditions for copying operation include those for producing a single printed output of the standard A4 size in a one-to-one magnification ratio with a medium print density or medium exposure volume. These standard conditions of copying operation are established not only as initial conditions immediately after the apparatus is switched in but as when a particular key (usually called "all-clear" key) on the control panel is depressed to clear all the conditions for copying operation which have been selected and established. The standard conditions of copying operation may also be established automatically upon lapse of a predetermined period of time after the last one of the keys depressed was depressed or after a single cycle of copying operation is terminated.

In the meantime, a duplicating apparatus is known and in use which has a function or mode of operation to accept conditions for copying operation selected on the basis of data supplied from an external data source which is typically an IC card. In an IC card for use with a duplicating apparatus of this type are ordinarily stored various optional conditions for copying operation which are likely to be most frequently used by the user of the particular apparatus. Examples of such "IC-card optional" conditions for copying operation include those for producing a total of 14 printed outputs of the standard A4 size in a 1-to-1.2 magnification ratio with a medium print density.

In using a duplicating apparatus of the type thus allowing the use of IC-card optional conditions for copying operation, the operator of the apparatus may sometimes desire to shift the conditions for copying operation from those dictated by the IC card set in the apparatus to those which the operator selects from the control panel.

It is, accordingly, an important object of the present invention to provide an improved image duplicating apparatus of the type having an IC-card controlled mode of operation in which are to be established the standard conditions for copying operation when predetermined "initial" requirements are satisfied in the absence of an IC card set in the apparatus and the IC-card optional conditions for copying operation when the predetermined requirements are satisfied in the presence of an IC card set in the apparatus. Typically, such initial requirements are satisfied (1) automatically when the apparatus is initially switched in and connected to a power source, (2) in a manual fashion when the all-clear key on the control panel is depressed by the operator, (3) automatically upon lapse of a predetermined period of time after the last one of the keys depressed on the control panel was depressed, and (4) automatically upon lapse of a predetermined period of time after a single cycle of copying operation was terminated.

In the meantime, an image duplicating apparatus usually has a certain maximum limit in the quantity of the printed outputs to be produced during a single cycle of copying operation for a single document sheet. For example, an ordinary image duplicating apparatus is capable of producing a maximum of 99 printed outputs during a single cycle of copying operation. In using a duplicating apparatus of the type allowing the use of IC-card optional conditions for copying operation, it may thus happen that the data stored in the IC card require the apparatus to produce printed outputs of a quantity exceeding such a maximum permissible quantity of printed outputs during a single cycle of copying operation.

It is, therefore, another important object of the present invention to provide an improved image duplicating apparatus of the type having an IC-card controlled mode of operation and allowing uninterrupted production of printed outputs of a quantity larger than the permissible quantity of printed outputs during a single cycle of copying operation.

In an IC card for use with a duplicating apparatus of the type having the IC-card controlled mode of operation may be stored data requiring IC-card optional conditions or functions for copying operation including those which are unacceptable in the apparatus in use. An example of such unacceptable functions is the selection of a magnification ratio larger than 1:1.420 or smaller than 1:0.640 in a duplicating apparatus having the permissible magnification ratio ranging from 1:0.640 to 1:1.420. Another example of the unacceptable functions is the selection of the standard A3 size for the print sheets to be used in a duplicating apparatus conditioned or designed to be capable of using the standard B4 or smaller sizes. If the operator of the apparatus dares or happens to start the apparatus for copying operation with the IC card loaded in the apparatus, the apparatus might operate erroneously or, in the least, could not operate in a manner expected or intended by the operator.

Thus, it is still another important object of the present invention to provide an improved image duplicating apparatus of the type having an IC-card controlled mode of operation and further having a function to produce a warning signal when any of the IC-card optional conditions or functions required by the data read from the IC card loaded into the apparatus are detected to be unacceptable in the apparatus.

During operation of a duplicating apparatus of the type having an IC-card controlled mode of operation, any failure such as typically jamming of a print sheet may take place within the apparatus. When such a failure occurs during IC-card controlled mode of operation for producing a plurality of printed outputs, the operator of the apparatus will complete the remaining cycle of copying operation after the failure is remedied or may attempt to complete the remaining cycle of operation with use of another duplicating apparatus which is in a sound state. Required to be produced by this remaining cycle of operation are printed outputs of a quantity resulting from the deduction of the quantity of the printed outputs already produced from the quantity of printed outputs represented by the data initially loaded into the apparatus from the IC card. The desired quantity of printed outputs represented by the data stored in the IC card is however fixed in the card and, for this reason, a total of such a quantity of printed outputs including surplus ones will be produced in the cycle of copying operation re-started in the apparatus which has been troubleshot or in another failure-free apparatus.

Accordingly, it is still another important object of the present invention to eliminate such an inconvenience through provision of an improved image duplicating apparatus capable of producing only a required or remaining quantity of printed outputs when the apparatus is restarted after a failure in the apparatus has been remedied or when the IC card which has been loaded in the apparatus involving a failure is used on another failure-free duplicating apparatus.

An image duplicating apparatus is also known which has an interrupt mode of operation allowing the operator to interrupt the operation of the apparatus currently in progress and enter new conditions for copying operation for causing the apparatus to operate under the conditions newly entered. When the copying operation under the new conditions is complete, the apparatus restores the conditions which have been selected for the interrupted operation and thus carries out the remaining portion of the previous cycle of copying operation.

Where the function to establish IC-card optional conditions for copying operation is incorporated into a duplicating apparatus having such an interrupt mode of operation, problems will be encountered when the interrupt mode of operation is requested from the IC card loaded into the apparatus. Problems will also arise when the IC card which has once been loaded into the apparatus is removed therefrom while the IC-card optional conditions for copying operation are established within the apparatus.

It is, thus, still another important object of the present invention to provide useful solutions to these problems in an image duplicating apparatus having an interrupt mode of operation in addition to the function to establish IC-card optional conditions of copying operation.

SUMMARY OF THE INVENTION

In accordance with a first outstanding aspect of the present invention, there is provided an image duplicating apparatus for use with an external data storage medium storing data representative of optional conditions for duplicating operation, the apparatus having predetermined standard conditions for duplicating operation and an externally controlled mode of operation in which are to be established the optional conditions for duplicating operation on the basis of the data stored in the external data storage medium, comprising a) control means for establishing conditions for duplicating within the apparatus, b) coupling means having a first state having the external data storage medium uncoupled from the control means and a second state having the external data storage medium detachably coupled to the control means, c) detecting means for detecting each of the first and second states of the coupling means and informing the control means of the detected state of the coupling means, and d) initial condition producing means for producing a predetermined initial condition in the control means without respect to the first and second states of the coupling means, e) the control means being responsive to the predetermined initial condition and to the first state of the coupling means for establishing the standard conditions for duplicating operation within the apparatus and responsive to the predetermined initial condition and to the second state of the coupling means for establishing the optional conditions for duplicating operation within the apparatus.

In accordance with a second outstanding aspect of the present invention, there is provided an image duplicating apparatus for use with an external data storage medium storing data representative of optional conditions for duplicating operation, the apparatus being capable of producing a predetermined maximum quantity of printed outputs during a single cycle of duplicating operation and having an externally controlled mode of operation in which are to be established the optional conditions for duplicating operation on the basis of the data stored in the external data storage medium, the data stored in the external data storage medium including a printed output quantity data indicating the quantity of printed outputs to be produced during a single cycle of duplicating operation of the apparatus, comprising a) control means operative to establish conditions for duplicating within the apparatus, b) coupling means for detachably coupling the external data storage medium to the control means, and c) memory means for storing data fetched from the external data storage medium through the coupling means, d) the control means being further operative to deduct the predetermined maximum quantity of printed outputs from the quantity of printed outputs indicated by the output quantity data currently stored in the memory means each time the predetermined maximum quantity of printed outputs is produced by the apparatus, update the stored output quantity data in the memory means each time the predetermined maximum quantity of printed outputs is deducted from the quantity of printed outputs indicated by the output quantity data until the output quantity data stored in the memory means is indicative of a quantity of printed outputs less than the predetermined maximum quantity of printed outputs, and decrement the stored output quantity data in the memory means each time a printed output is produced by the apparatus until the output quantity data is indicative of no printed output remaining to be produced after the output quantity data in the memory means indicated the quantity of printed outputs less than the predetermined maximum quantity.

In accordance with a third outstanding aspect of the present invention, there is provided an image duplicating apparatus for use with an external data storage medium storing data representative of optional conditions for duplicating operation, the apparatus having a multiplicity of duplicating conditions which can be selectively executed, the apparatus further having an externally controlled mode of operation in which are to be established the optional conditions for duplicating operation on the basis of the data stored in the external data storage medium, comprising a) control means operative to establish conditions for duplicating within the apparatus, b) coupling means for detachably coupling the external data storage medium to the control means, c) memory means for storing data fetched from the external data storage medium through the coupling means, d) the control means being further operative to detect whether or not each of the optional conditions for duplicating operation represented by the data stored in the memory means falls within the range of the multiplicity of duplicating conditions which can be executed by the apparatus, and produce a signal when it is detected that any of the optional conditions for duplicating operation represented by the data stored in the memory means falls out of the range of the multiplicity of duplicating conditions, and e) signal generating means responsive to the signal for generating a physically perceptible signal.

In accordance with a fourth outstanding aspect of the present invention, there is provided an image duplicating apparatus for use with an external data storage medium storing data representative of optional conditions for duplicating operation, the apparatus having a multiplicity of duplicating conditions which can be selectively executed and which include predetermined standard conditions for duplicating operation, the apparatus further having an externally controlled mode of operation in which are to be established the optional conditions for duplicating operation on the basis of the data stored in the external data storage medium, comprising a) control means for establishing conditions for duplicating within the apparatus, b) coupling means having a first state having the external data storage medium uncoupled from the control means and a second state having the external data storage medium detachably coupled to the control means, c) detecting means for detecting each of the first and second states of the coupling means and for informing the control means of the detected state of the coupling means, and d) initial condition producing means for producing a predetermined initial condition in the control means without respect to the first and second states of the coupling means, e) the control means being responsive to the predetermined initial condition and to the first state of the coupling means for establishing the standard conditions for duplicating operation within the apparatus and responsive to the predetermined initial condition and to the second state of the coupling means for establish the optional conditions for duplicating operation within the apparatus f) the control means being further operative to detect whether or not each of the optional conditions for duplicating operation represented by the data stored in the memory means falls within the range of the multiplicity of duplicating conditions which can be executed by the apparatus, and produce a signal when it is detected that any of the optional conditions for duplicating operation represented by the data stored in the memory means falls out of the range of the multiplicity of duplicating conditions, and g) signal generating means responsive to the signal for generating a physically perceptible signal.

In accordance with a fifth outstanding aspect of the present invention, there is provided an image duplicating apparatus for use with an external data storage medium storing data representative of optional conditions for duplicating operation, the external data storage medium having a memory area for storing therein updatable output quantity data initially indicating the quantity of printed outputs to be produced during a single cycle of duplicating operation, the apparatus having an externally controlled mode of operation in which are to be established the optional conditions for duplicating operation on the basis of the data stored in the external data storage medium, comprising a) control means operative to establish conditions for duplicating within the apparatus, b) coupling means for detachably coupling the external data storage medium to the control means, c) memory means for storing data fetched from the external data storage medium through the coupling means, and d) detecting means responsive to an occurrence of a failure in the apparatus for producing a signal indicative of the occurrence of the failure detected, e) the control means being further operative to update the output quantity data in the memory means each time a printed output is produced by the apparatus, and to update the output quantity data in the memory area of the external data storage medium data in accordance with the current output quantity data in the memory means in response to the signal from the detecting means.

In accordance with a sixth outstanding aspect of the present invention, there is provided an image duplicating apparatus for use with an external data storage medium storing data representative of optional conditions for duplicating operation, the apparatus having a multiplicity of duplicating conditions which can be selectively executed, the apparatus further having an externally controlled mode of operation in which are to be established the optional conditions for duplicating operation on the basis of the data stored in the external data storage medium and an interrupt mode of operation allowing interruption of a cycle of duplicating operation currently in progress, comprising a) control means for selecting any ones of the multiplicity of duplicating conditions and establishing the selected duplicating conditions within the apparatus, b) memory means for storing data representative of the duplicating conditions selected by the control means or the data fetched from the external data storage medium c) coupling means having a first state having the external data storage medium uncoupled from the control means and a second state having the external data storage medium detachably coupled to the control means, d) detecting means for detecting each of the first and second states of the coupling means and for informing the control means of the detected state of the coupling means, e) memory means for storing data representative of the duplicating conditions selected by the control means in response to the first state of the coupling means and the data fetched from the external data storage medium through the coupling means in response to the second state of the coupling means, f) the control means being responsive to transition from the second state to the first state of the coupling means for updating the data in the memory means with the data representative of the duplicating conditions which have been established prior to the transition from the second state to the first state, and establishing the optional conditions for duplicating operation within the apparatus, and responsive to transition from the first state to the second state of the coupling means for establishing the duplicating conditions represented by the data in the memory means updated in response to the transition from the second state to the first state.

In accordance with a seventh outstanding aspect of the present invention, there is provided an image duplicating apparatus for use with an external data storage medium storing data representative of optional duplicating conditions, the apparatus having a multiplicity of duplicating conditions which can be selectively executed, the apparatus further having an externally controlled mode of operation in which are to be established said optional duplicating conditions for duplicating operation on the basis of the data stored in said external data storage medium, comprising a) control means operative to establish conditions for duplicating within the apparatus, b) coupling means for detachably coupling said external data storage medium to said control means, and c) judging means for judging whether or not a particular one of said optional duplicating conditions is acceptable in the apparatus and for inhibiting said control means from establishing the particular optional duplicating condition when it is judged that the particular optional duplicating condition is not acceptable.

In accordance with an eighth outstanding aspect of the present invention, there is provided an image duplicating apparatus for use with an external data storage medium storing data representative of optional duplicating conditions, the apparatus having a multiplicity of duplicating conditions which can be selectively executed, the apparatus further having an externally controlled mode of operation in which are to be established said optional duplicating conditions for duplicating operation on the basis of the data stored in said external data storage medium, comprising a) control means operative to establish conditions for duplicating within the apparatus, b) coupling means for detachably coupling said external data storage medium to said control means, and c) judging means for judging whether or not a particular one of said optional duplicating conditions is acceptable in the apparatus and, when it is judged that the particular one of said optional duplicating conditions is not acceptable, prompting said control means to establish the optional duplicating condition which had been selected before said external data storage medium was coupled to said control means.

BRIEF DESCRIPTION OF THE DRAWINGS

The features and advantages of an image duplicating apparatus according to the present invention will be more clearly appreciated from the following description taken in conjunction with the accompanying drawings in which:

FIGS. 12A, 12B and 12C are flowcharts showing a modification of the IC-card controlled mode select control subroutine program illustrated in FIG. 7A to 7D;

DESCRIPTION OF THE PREFERRED EMBODIMENT

General Construction of Apparatus

Figure 1:
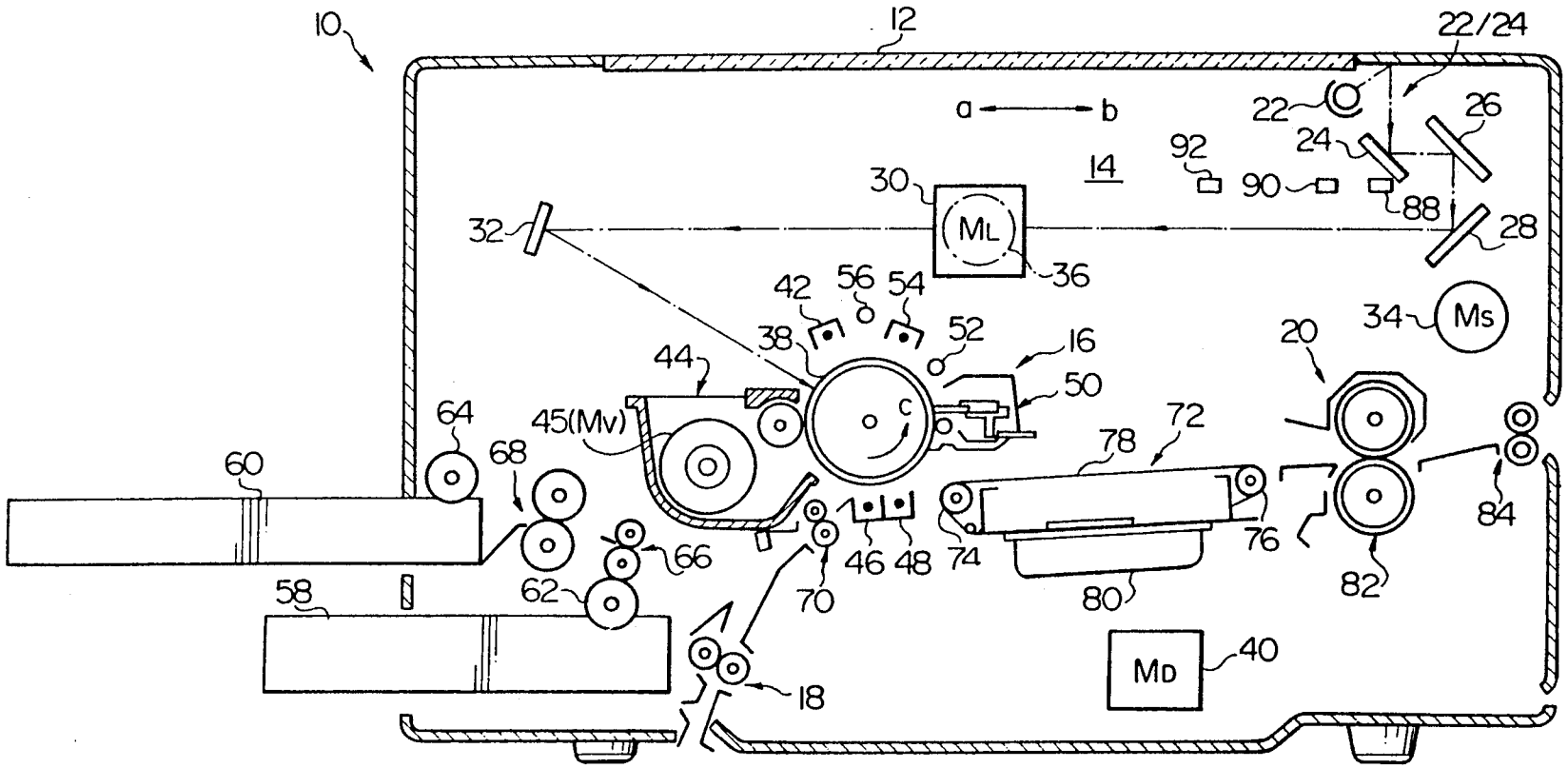
FIG. 1 is a side elevation view showing the general mechanical construction and arrangement of a preferred embodiment of an image duplicating apparatus according to the present invention.

As shown in FIG. 1, an image duplicating apparatus embodying the present invention comprises a housing 10 having an upper panel portion which is in part provided by a transparent document support table 12. A sheet of document bearing images to be reproduced is placed on this document support table 12. The apparatus further comprises an optical document scanning system 14, an image reproducing system 16, a paper feed mechanism 18 and an image fixing assembly 20.

The optical document scanning system 14 comprises a light exposure lamp 22 from which a beam of light is emitted toward the lower face of the document sheet on the document support table 12. The beam of light incident on and reflected from the document sheet is downwardly directed to an object mirror 24 and is redirected rightwardly in the housing 10. The lamp 22 and object mirror 24 are movable together along the document support table 12 and implement, in combination, a document scanner 22/24 of the apparatus under consideration. The document scanner 22/24 has a predetermined home position with respect to the document support table and is movable leftwardly from and rightwardly back to the home position as indicated by arrows a and b in the drawing. The home position of the document scanner 22/24 is herein assumed to be close to the rightmost end of the document support table 10 as shown.

The light reflected from the object mirror 24 is redirected toward a second mirror 26, which further redirects the light downwardly toward a third mirror 28. The mirrors 26 and 28 are also movable along the document support table 12 into and out of predetermined home positions with respect to the document support table. From the mirror 28, the light travels leftwardly along the document support table 12 and is passed through an image magnification/reduction lens unit 30 (hereinafter referred to simply as magnification lens unit) to a projection mirror 32. The magnification lens unit 30 is movable along the document support table 12 independently of the document scanner 22/24 and the combination of the mirrors 26 and 28 with respect to the table 12. Movement of the magnification lens unit 30 in either direction with respect to the projection mirror 32 results in a change in the magnification/reduction ratio (hereinafter referred to simply as magnification ratio) of the images to be reproduced.

The document scanner 22/24 composed of the combination of the exposure lamp 22 and mirror 24 is operatively coupled to suitable drive means and is to be driven to travel at a speed doubling the speed of movement of the combination of the mirrors 26 and 28. Such drive means is also operative to drive the combination of the mirrors 26 and 28 and is herein assumed to include a d.c. scanner drive motor 34 ($M_S$) and a suitable reduction gear mechanism (not shown). The magnification lens unit 30 is also operatively coupled to suitable drive means, which is assumed to include a pulse-driven stepper motor 36 and will be referred to as lens drive motor ($M_L$).

The image reproducing system 16 comprises a cylindrical image transfer drum 38 having a conductive peripheral surface layer coated with a photoconductive substance. The light directed to the image reproducing system 16 is re-directed toward this image transfer drum 38 and is focused onto the peripheral surface of the drum 38. The image transfer drum 38 is driven for rotation in a direction indicated by arrow c by appropriate drive means, which is assumed to include a main drive motor 40 ($M_D$). The document scanner 22/24 and the combination of the mirrors 26 and 28 are driven for movement at speeds proportional to the peripheral speed (V) of rotation of the image transfer drum 38. A change in the position of the magnification lens unit 30 with respect to the image transfer drum 38 results in a change in the magnification ratio (N) of the images to be reproduced. In the embodiment herein shown, it is assumed by way of example that the document scanner 2/24 composed of the lamp 22 and mirror 24 are driven for movement at a speed V/N and the combination of the mirrors 26 and 28 driven at a speed V/2N.

The image reproducing system 16 further comprises a main charger 42 to sensitize the photoconductive peripheral surface of the image transfer drum 38 by applying electrostatic charges uniformly to the surface of the drum 38. These charges are dissipated in areas exposed to light and electrostatic latent images are created by the charges remaining on the drum 38 upon irradiation with light from the mirror 32. Posterior to the path of light to the drum 38 is located an image developing unit 44 having a stock of toner particles to be applied to the photoconductive peripheral surface of the image transfer drum 38. Visible toner images are thus produced conformingly to the latent images produced on the peripheral surface of the drum 38. The image developing unit 44 has a developer drive motor 45 ($M_V$) incorporated therein.

Posterior to the image developing unit 44 in turn is provided an image transfer charger 46 which is operative to charge a print sheet so that the toner images on the image transfer drum 38 are transferred to the print sheet. The print sheet thus having the toner images received thereon is cleared of remaining charges by a separation charger 48 located posterior to the image transfer charger 46. There is further provided a drum cleaner unit 50 which removes residual toner particles from the peripheral surface of the drum 38. Posterior to this cleaner unit 50 in turn is positioned a main charge eraser lamp 52 which irradiates the cleaned peripheral surface of the drum 38 to eliminate the charges which may be left thereon. Indicated at 54 and 56 are an auxiliary charger and an auxiliary charge eraser lamp, respectively. Though not shown, each of the chargers 42, 46, 48 and 54, developing and cleaner units 44 and 50 and eraser lamps 52 and 56 includes or is associated with appropriate driver or actuator means.

The print-sheet feed mechanism 18 is provided in conjunction with lower and upper print-sheet supply cassettes 58 and 60 which are detachably fitted to the housing 10 and which have stocks of print sheets of different sizes stored therein. The print-sheet feed mechanism 18 per se comprises lower and upper print-sheet feed rollers 62 and 64 each of which is driven for rotation to pick up print sheets one after another from the stack of paper in the cassette 58 or 60. The print sheet picked up by the lower print-sheet feed roller 62 is guided to travel directly toward the image transfer drum 38. The print-sheet feed roller 62 is held in rollable contact with one of a pair of guide rollers 66 which are held in rollable contact with each other. In association with the upper print-sheet supply cassette 60 is provided a pair of guide rollers 68 which are held in rollable contact with each other and which are located between the upper print-sheet feed roller 64 and the pair of guide rollers 66. A print sheet picked up by the upper print-sheet feed roller 64 is first passed between the guide rollers 68 and subsequently between the guide rollers 66 and is thereafter directed toward the image transfer drum 38.

Posterior to the developing unit 44 is provided a pair of timing rollers 70 which are held in rollable contact with each other. A print sheet passed from the lower print-sheet feed roller 62 or through the guide rollers 66 is passed to the timing rollers 70. The timing rollers 70 are to be driven for rotation at a timing synchronized with the movement of the document scanner 22/24. Each of the print-sheet feed rollers 62 and 64 and one of the timing rollers 70 is operatively connected to the main drive motor 40 through an actuator typically implemented by a solenoid-operated clutch (not shown).

The print-sheet feed mechanism 18 further comprises a print-sheet transport belt assembly 72 positioned posterior to the area where a print sheet is to be separated from the image transfer drum 38. The transport belt assembly 72 comprises spaced driven and idler rollers 74 and 76 and an endless transport belt 78 passed between the rollers 74 and 76. The transport belt 78 may be formed with perforations provided in conjunction with any suction generator unit 80. The suction induced by the suction generator unit 80 acts, through the perforations in the belt 78, on the print sheet being transported on the belt 78 and retains the print sheet to the belt 78 until the print sheet is released from the belt 78.

The image fixing assembly 20 is provided at the rear of the transport belt assembly 72 and comprises a pair of heater rollers 82 arranged to form therebetween a nip aligned with the path of travel of a print sheet from the belt assembly 72. The print sheet transported on the transport belt 78 is thus nipped between the heater rollers 82 so that the toner particles carried on the sheet are thermally fused and the toner images are fixed on the print sheet. The print sheet released from the rollers 82 is withdrawn to a paper collect tray (not shown) through a pair of paper discharge rollers 84 located posterior to the heater rollers 82 and a paper discharge slot provided in the rear panel portion of the housing 10.

Various sensors and detectors are provided which include a home position sensor 88 and a scan timing sensor 90 located in association with, for example, the exposure lamp 22. The home position sensor 88 produces a home position signal $S_{HP}$ of a logic "1" state in the presence of the document scanner 22/24 in the home position thereof while the scan timing sensor 90 produces a scan timing signal $S_{ST}$ of a logic "1" state at a timing the document scanner 22/24 driven for movement with respect to the document support table 12 reaches a predetermined position ahead of its home position. Also provided is a lens position sensor 92 for detecting the position of the magnification lens unit 30 with respect to the image transfer drum 38. The sensor 92 implements means for detecting the magnification ratio which is variable with the movement of the magnification lens unit 38 with respect to the drum 38.

General Configuration of Control Panel

Figure 2:
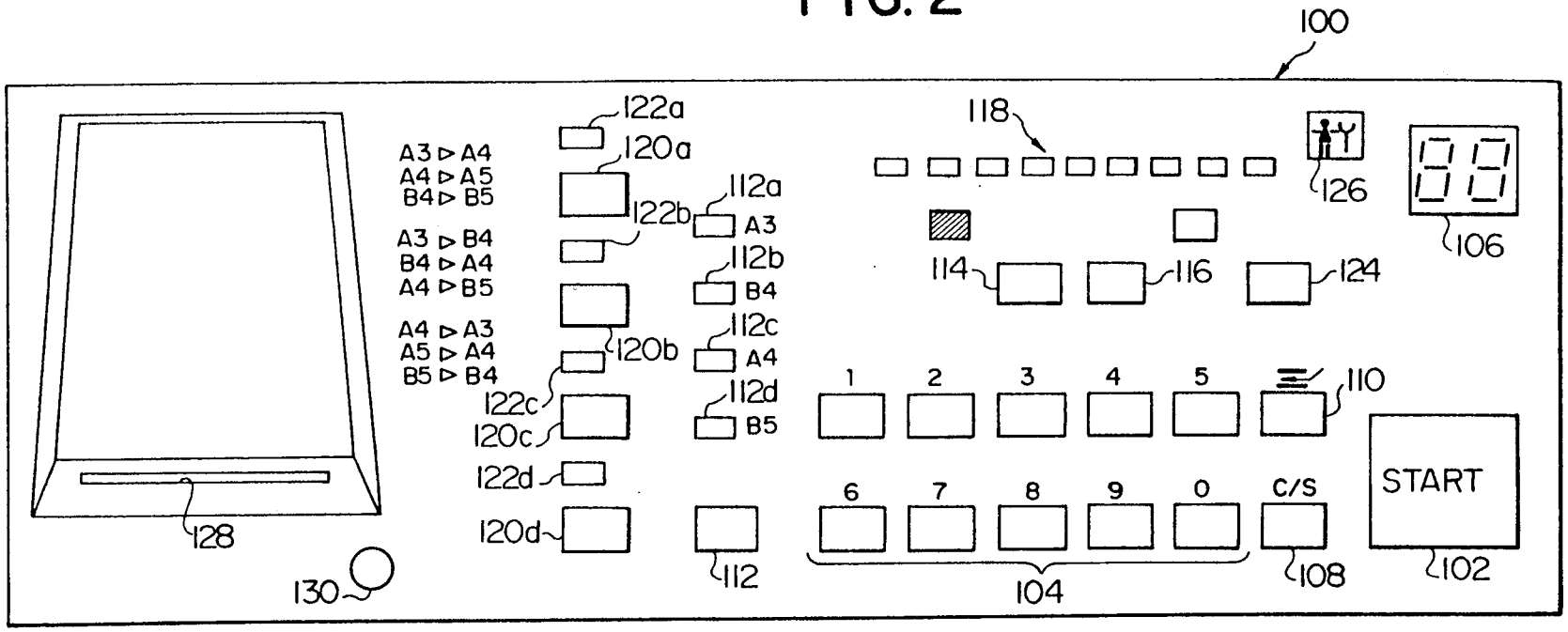
FIG. 2 is a plan view schematically showing the general configuration of the control panel forming part of the image duplicating apparatus illustrated in FIG. 1.

FIG. 2 shows the general configuration of a control panel 100 which forms part of the apparatus embodying the present invention. The control panel 100 comprises a print start key 102 (START) to start duplicating operation and a set of numerical keys 104 allocated to numerals 1, 2, . . . 9, 0, through any of which a desired quantity of printed outputs to be produced is to be entered. The numerals indicating the desired quantity of printed outputs thus entered through any of these numerical keys 104 is visually displayed on a seven-segment numerical display window 106 and can be cleared from a clear/stop key 108 (C/S) which may be used also for cancelling the instruction once entered from the print start key 102. During printing of a preset quantity of print sheets for a given document sheet, another document sheet may be duplicated in an interrupt mode entered through an interrupt request key 110.

The size of print sheets to be used can be selected at a manual paper-size select key 112 from among a predetermined number of standard or otherwise preset sizes available. The selected size of print sheets is displayed by any of paper-size indicators 112*a* to 112*d* which are assumed to be assigned to the standard A3, B4, A4 and B5 sizes, respectively, as shown. The paper-size select key 112 is, in effect, operative to select one of the print-sheet supply cassettes 58 and 60 currently assembled to the apparatus shown in FIG. 1.

Further provided on the control panel 100 are print density increment and decrement keys 114 and 116 to permit manual selection of a desired print density for the print sheets to be printed. The print density is stepwise incremented with the key 114 depressed or is decremented with the key 116 depressed. A series of print density indicators 118 are provided, which are to be activated to illuminate successively in one direction with the increment key 114 kept depressed and in the other direction with the decrement key 116 kept depressed. In the control panel 100 are further provided a set of magnification ratio select keys 120*a* to 120*d* and respectively associated indicators 122*a* to 122*d*. The keys 120*a* to 120*d* are assumed to be used for the selection of a first-ratio reduced copying mode, a second-ratio reduced copying mode, a magnified copying mode and a one-to-one ratio copying mode, respectively. With one of the keys 120*a* to 120*d* depressed, the associated one of the indicators 122*a* to 122*d* illuminates to indicate the selected ratio for reduced or magnified scale copying.

On the control panel 100 is further provided an all-clear key 124 to cancel all the instructions which have been entered before the print start key 102 is depressed. When this all-clear key 124 is depressed, all the modes of operation and copying conditions are initialized to establish those prescribed in accordance with default rules. There is further provided a failure indicator 126 which is to be activated to illuminate in the event any failure such as jamming of a print sheet occurs within the duplicating apparatus.

The control panel 100 of the apparatus embodying the present invention is further provided with an IC card insertion slot 128 through which an IC card is to be manually inserted into the control panel 100. In association with this IC card insertion slot 128 is provided an unacceptable function indicator 130 which is to be activated to illuminate when any of the modes and conditions of operation or functions indicated by the data memorized in the IC card loaded into the control panel 100 is not operable in the duplicating apparatus currently in use.

Each of the indicators provided on the control panel 100 is implemented typically by a light emitting diode (LED).

General Arrangement of Control Circuit

Figure 3:
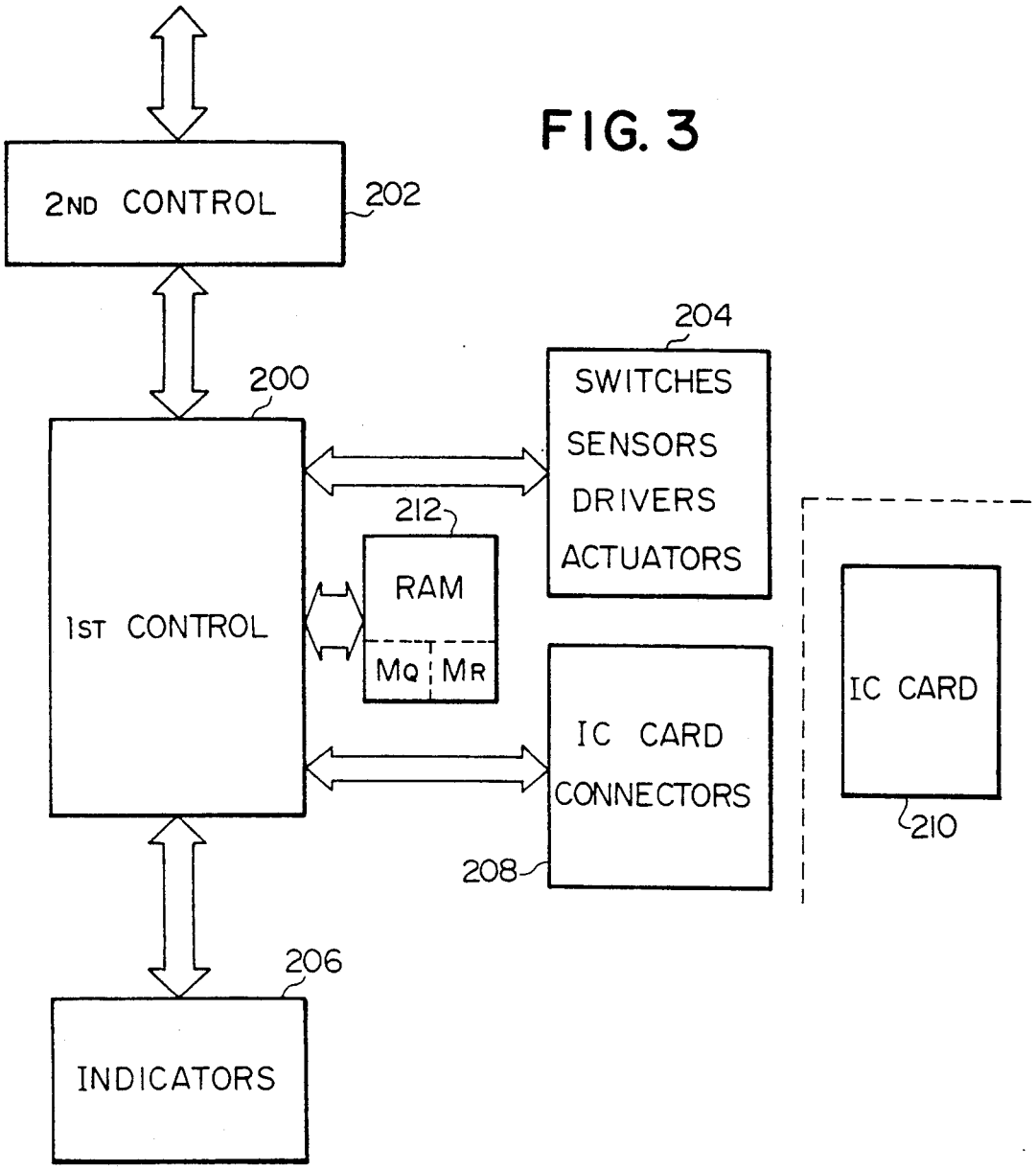
FIG. 3 is a diagram schematically showing the general arrangement of a control circuit which may be incorporated in the image duplicating apparatus embodying the present invention.

FIG. 3 shows the general arrangement of a control circuit which may be used to achieve various modes and conditions for copying operation in the apparatus embodying the present invention. The control circuit comprises first and second control units 200 and 202 each of which is implemented by a microprocessor unit (MPU) having an interrupt port and first and second sets of data input/output ports. The interrupt and first set of data input/output ports of the first control unit 200 are connected through a directional bus to the interrupt port and first data input/output ports, respectively, of the second control unit 202. The first control unit 200 is mainly operative to control the operation of the image reproducing system 16 and print-sheet feed mechanism 18 while the second control unit 202 is predominant over the operation of the optical document scanning system 14.

The first control unit 200 has its second set of data input/output ports connected through lines to various switches, sensors, driver circuits and actuators provided in association with the image reproducing system 16 and print-sheet feed mechanism 18. The switches thus connected to the first control unit 200 include those connected to the various keys provided on the control panel 100 as well as the main or power supply switch (not shown) provided on the duplicating apparatus. The sensors connected to the control unit 200 include sensors to detect the presence or absence of the lower and upper print-sheet supply cassettes 58 and 60, and sensors to detect the presence or absence of stocks of print sheets in the print-sheet supply cassettes 58 and 60, though not shown in the drawings. The driver and actuator means connected to the control unit 200 include driver circuits for the main drive motor 40 ($M_D$), main charger 42, developer drive motor 44 ($M_V$), transfer charger 46, separation charger 48, main charge eraser lamp 52, auxiliary charger 54, auxiliary eraser lamp 56 and actuators such as the solenoid-operated clutches for the print-sheet feed rollers 62 and 64 and timing rollers 70. All the switches, sensors and driver and actuator means thus connected to the second set of input/output ports of the first control unit 200 are herein collectively represented by a block 204. The first control unit 200 receives signals produced by any of these switches and sensors and outputs control signals to activate any of the driver and actuator means so that the image reproducing system 16 and print-sheet feed mechanism 18 of the apparatus operate on the basis of the signals from the switches and sensors.

The second control unit 202 has its second set of input/output ports connected to various sensors and driver means provided in association with the optical document scanning system 14. The sensors thus connected to the second control unit 202 include the home position sensor 88, scan timing sensor 90 and lens position sensor 92 and the driver means connected to the control unit 202 include those for the exposure lamp 22, scanner drive motor 34 ($M_S$) and lens drive motor ($M_L$) hereinbefore described with reference to FIG. 1. The second control unit 202 is thus operative to control the optical document scanning system 14 under the control of the first control unit 200 on the basis of the signals including those from the sensors 88, 90 and 92.

The first control unit 200 further has a third set of data input/output ports connected to the driver means for the various indicators provided on the control panel 100. These indicators are collectively represented by a block 206 in FIG. 3.

The first control unit 200 of the control system incorporated in the apparatus embodying the present invention further has a fourth set of data input/output ports connected to a set of connectors 208 provided for connection to various terminals formed on an IC card 210. Thus, the control system of the apparatus embodying the present invention is operative to control the various functional units and elements of the apparatus on the basis of not only the signals produced by the various switches and sensors provided in the apparatus but also the signals which may be supplied through the connectors 208 when an IC card 210 is inserted into the control panel 100 through the IC card insertion slot 128 provided in the panel 100.

In association with the first control unit 200 are provided memories including a random-access memory 212 which has memory areas $M_Q$ and $M_R$ as will be described hereinafter.

Main Routine Program

Figure 4:
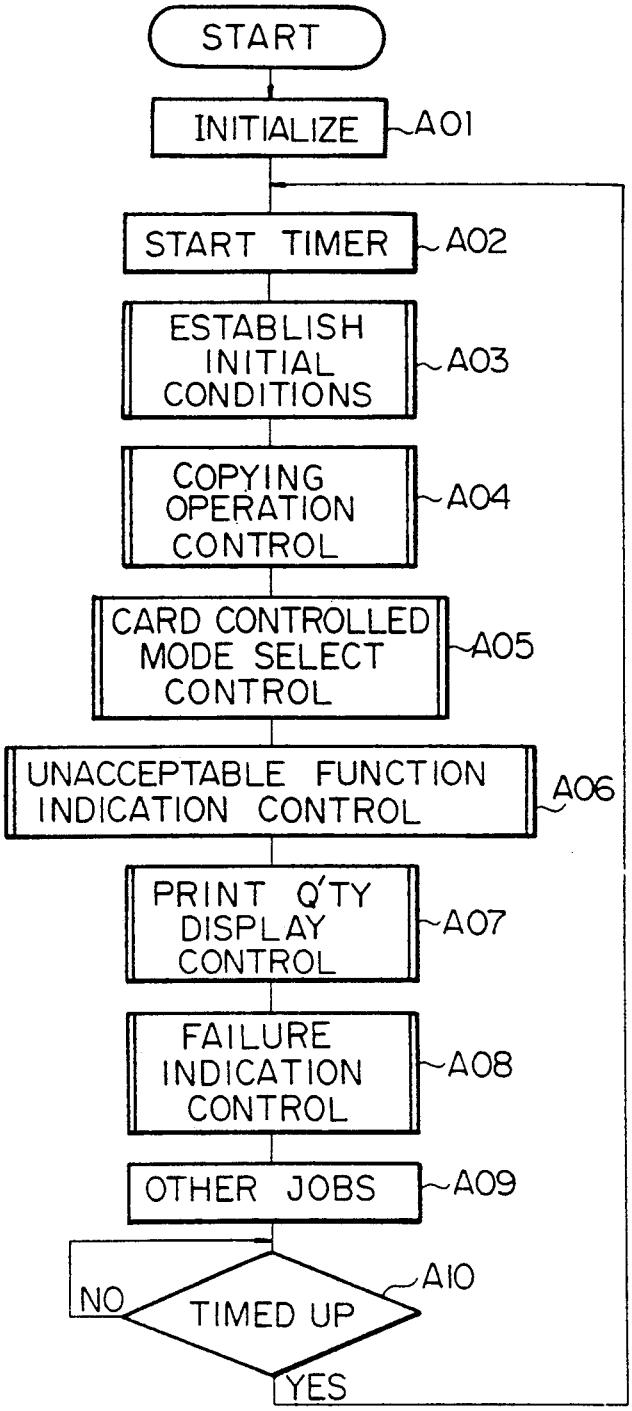
FIG. 4 is a flowchart showing an example of the main routine program to be executed by a main control unit included in the control circuit illustrated in FIG. 3.

FIG. 4 shows the main routine program to be executed by the first control unit 200 provided in the control circuit described with reference to FIG. 3. The routine program starts with the main switch of the duplicating apparatus turned on and at step A01 initialize the contents of the registers included in the control unit 200 and the random-access memory 212 provided in association with the control unit 200. An internal timer of the control unit 200 is then activated at step A02 to start counting of time until a time interval preset for a single complete iteration through the routine program elapses.

The first control unit 200 then executes an initial subroutine program A03 to establish initial conditions for copying operation in the duplicating apparatus in accordance with prescribed "default" rules. This initial subroutine program A03 is executed when prescribed requirements are met with, for example, the all-clear key 124 depressed by the operator. The initial conditions for copying operation thus established through execution of the initial subroutine program A03 depend on whether or not an IC card 210 is loaded into the control panel 100 and, thus, those established in the presence of an IC card set in the control panel 100 differ from those established in the absence of an IC card. The initial conditions for copying operation to be established in the absence of an IC card loaded into the control panel 100 are herein assumed to include those for producing a single printed output of the standard A4 size in a one-to-one magnification ratio with a medium print density. These initial conditions for copying operation will be herein referred to as standard conditions for copying operation. In contrast to such standard conditions for copying operation, the conditions for copying operation to be established when an IC card 210 is loaded into the control panel 100 will be herein referred to as IC-card optional conditions for copying operation. The details of a preferred example of the initial subroutine program A03 will be hereinafter described with reference to FIG. 5 and a modification of the subroutine program described with reference to FIG. 11.

The initial subroutine program A03 may be followed by a copying operation control subroutine program A04 to carry out a cycle or cycles of copying operation in accordance with the conditions selected on the basis of the signals supplied to the control unit 200 from the control unit 100 and/or any of the sensors provided in the apparatus or in accordance with the data read from the IC card loaded into the control panel 100. Such conditions for copying operation may include the size of the print sheet or sheets to be used and the quantity of the printed outputs to be produced. During execution of this copying operation control subroutine program A04, an automatic clear timer ($T_{AC}$) is activated to start counting of time to shift all the selected conditions of operation back to the above mentioned initial conditions for copying operation upon lapse of a preset period of time after the timer is started. The details of a preferred example of this copying operation control subroutine program A04 will be hereinafter described with reference to FIGS. 6A, 6B and 6C.

The first control unit 200 may thereafter execute an IC-card controlled mode select control subroutine program A05 to check if an IC card is loaded into the control panel 100 and, if the IC card is found loaded, establish the IC-card optional conditions for copying operation in accordance with the data stored in the IC card. In the absence of an IC card set in the control panel 100, the standard conditions for copying operation as above defined are established. The details of a preferred example of this IC-card controlled mode select control subroutine program A05 which will be hereinafter described with reference to FIGS. 7A to 7D and a modification of the subroutine program described with reference to FIGS. 12A to 12C.

The first control unit 200 may then execute an unacceptable function indication control subroutine program A06 to check if the functions required by the data stored in the IC card loaded into the control panel 100 are operable in the duplicating apparatus in use and, if this is not the case in respect of any of the functions, activate the unacceptable function indicator 130 to flicker to indicate that the particular function is not acceptable and thus the request for executing the function is invalid. As has been noted, an example of such unacceptable functions is the selection of a magnification ratio larger than 1:1.420 or smaller than 1:0.640 in a duplicating apparatus having the maximum and minimum permissible magnification ratios of 1:1.420 and 1:0.640, respectively. The details of a preferred example of this unacceptable function indication control subroutine program A06 will be hereinafter described with reference to FIG. 8.

Subsequently to the unacceptable function indication control subroutine program A06, the first control unit 200 may execute a print quantity display control subroutine program A07 to control the operation for visually indicating the selected quantity of the printed outputs which remain to be produced for a given document sheet. In the meantime, the duplicating apparatus under consideration is assumed to be capable of producing a maximum of 99 printed outputs by a single cycle of copying operation. The print quantity display control subroutine program A07 is also useful for controlling the operation to allow uninterrupted production of more than 99 printed outputs. The details of a preferred example of this print quantity display control subroutine program A07 will be hereinafter described with reference to FIGS. 9A to 9C and a modification of the subroutine program described with reference to FIG. 13.

Thereafter, the first control unit 200 may further execute a failure indication control subroutine program A08 to detect an occurrence of a failure such as, typically, jamming of a print sheet within the duplicating apparatus and activate the failure indicator 126 to illuminate in the event such a failure occurs. When a failure occurs with the IC-card optional conditions for copying operation established, the data representing the jobs which remain to be executed are withdrawn from the control unit 200 into the IC card set in the control panel 100. The details of a preferred example of this failure indication control subroutine program A08 will be hereinafter described with reference to FIG. 10.

The first control unit 200 may further execute a subroutine program A09 to perform various other jobs necessary for carrying out copying operation. These jobs include processing of the signals produced in the control panel 100, controlling temperatures, and inter-microprocessor communication. When it is detected at step A10 that the time interval set for the internal timer of the control unit 200 has elapsed, the main routine program reverts to the step A02 and recycles the subroutine programs A03 to A10.

Description will be hereinafter made with reference to FIG. 5 to FIGS. 13 in regard to the various subroutine programs thus included in the main routine program to be executed by the first control unit 200.

Initial Subroutine (A03)

Figure 5:
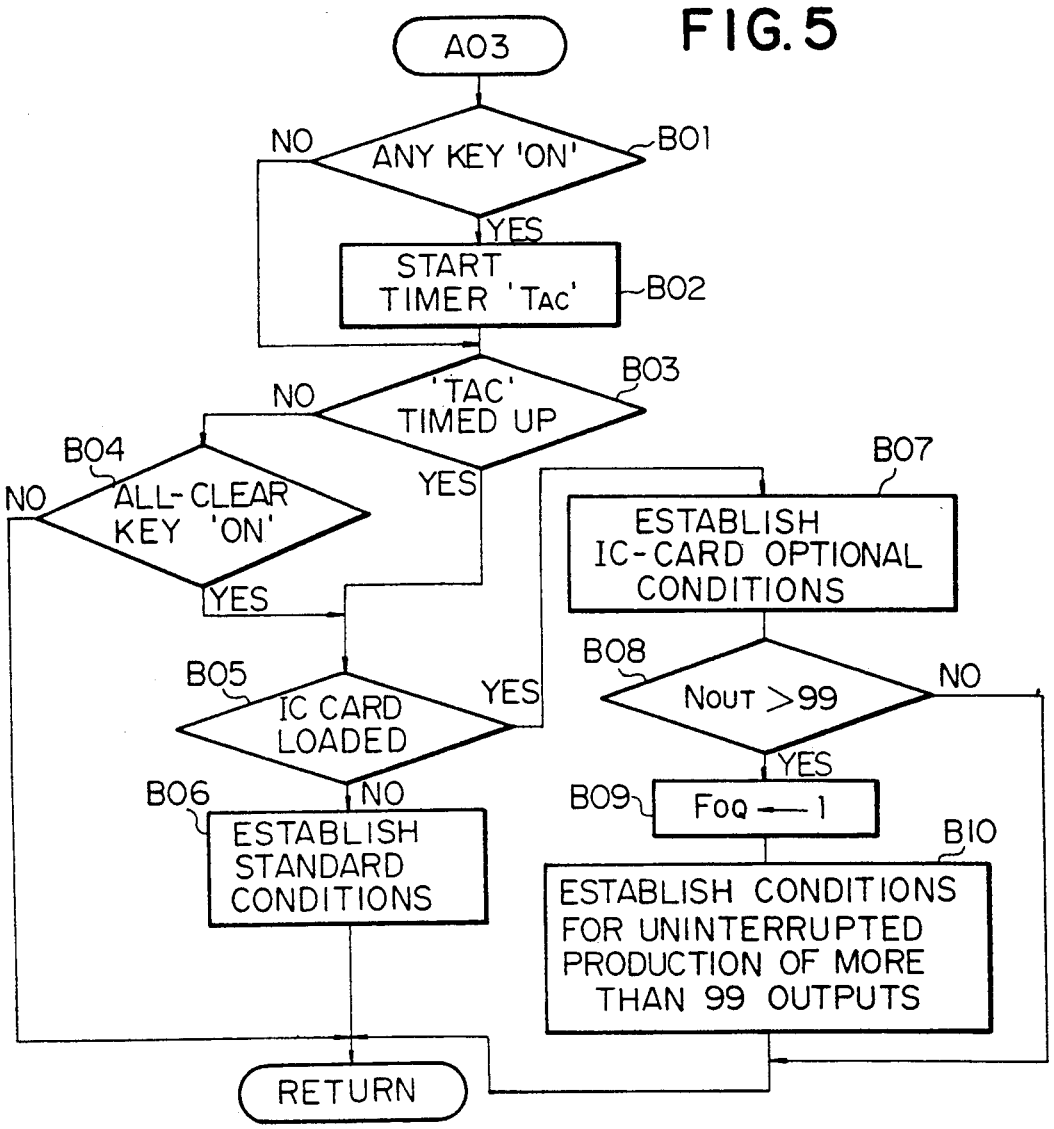
FIG. 5 is a flowchart showing the details of an initial subroutine program included in the main routine program illustrated in FIG. 4.

FIG. 5 shows the details of a preferred example of the initial subroutine program A03 included in the main routine program described with reference to FIG. 4. The initial subroutine program A03 starts with a decision step B01 at which it is checked if any of the keys on the control panel 100 has been depressed. If the answer for this decision step B01 is given in the affirmative, the automatic clear timer $T_{AC}$ is activated to start counting of time. The timer $T_{AC}$ is operative to count time for a period of time predetermined to shift the selected conditions of operation back to the initial conditions for copying operation upon lapse of the predetermined period of time after the timer has been started.

If it is determined at step B03 that the automatic clear timer $T_{AC}$ has terminated the counting operation or at step B04 that the all-clear key 124 has been depressed with the counting operation of the timer $T_{AC}$ still in progress, it is detected at step B05 whether or not an IC card 210 is loaded into the control panel 100. In the absence of an IC card 210 set in the control panel 100, the control unit 200 outputs signals to establish the standard conditions for copying operation at step B06 to make the apparatus ready for producing a single printed output of the standard A4 size in a one-to-one magnification ratio with a medium print density. After the standard conditions for copying operation are thus established at step B06, the control unit 200 reverts to the main routine program described with reference to FIG. 4 and may proceed to the copying operation control subroutine program A04.

If it is found at step B05 that there is an IC card 210 set in the control panel 100, the control unit 200 outputs signals to establish the IC-card optional conditions for copying operation at step B07 to make the apparatus ready for producing printed outputs in accordance with the conditions indicated by the data read from the IC card. After the IC-card optional conditions for copying operation are thus established at step B06, the control unit 200 proceeds to step B08 to check if the quantity $N_{OUT}$ of the printed outputs required to be produced by the data read from the IC card 210 is more than 99 which is assumed to be the maximum quantity of printed outputs which can be produced by a single cycle of copying operation. If the answer for this decision step B08 is given in the affirmative, an over-quantity flag $F_{OQ}$ of logic "1" state is raised at step B09, followed by a step B10 to establish conditions allowing uninterrupted production of more than 99 printed outputs. The over-quantity flag $F_{OQ}$ of logic "1" state indicates that the quantity $N_{OUT}$ of the printed outputs required to be produced by the data read from the IC card 210 is more than 99.

Subsequently to step B10 or when it is determined at step B08 that the quantity $N_{OUT}$ of the printed outputs required to be produced by the data read from the IC card 210 is not more than 99, the control unit 200 returns to the main program and may also proceed to the copying operation control subroutine program A04 to be hereinafter described with reference to FIGS. 6A to 6C.

Copying Operation Control Subroutine (A04)

Figure 6A:
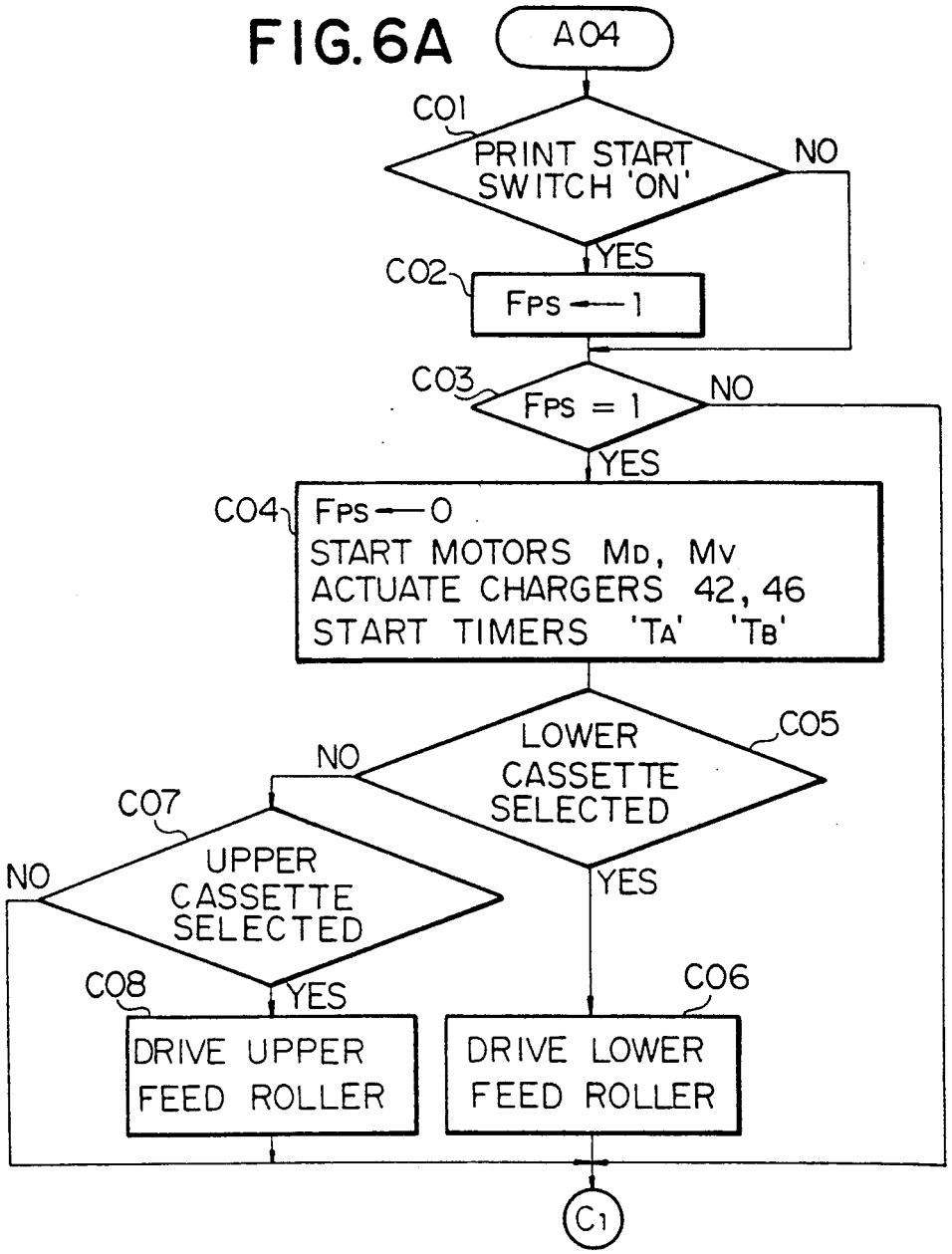
FIG. 6A, 6B and 6C are flowcharts showing the details of a copying operation control subroutine program included in the main routine program illustrated in FIG. 4.
Figure 6B:
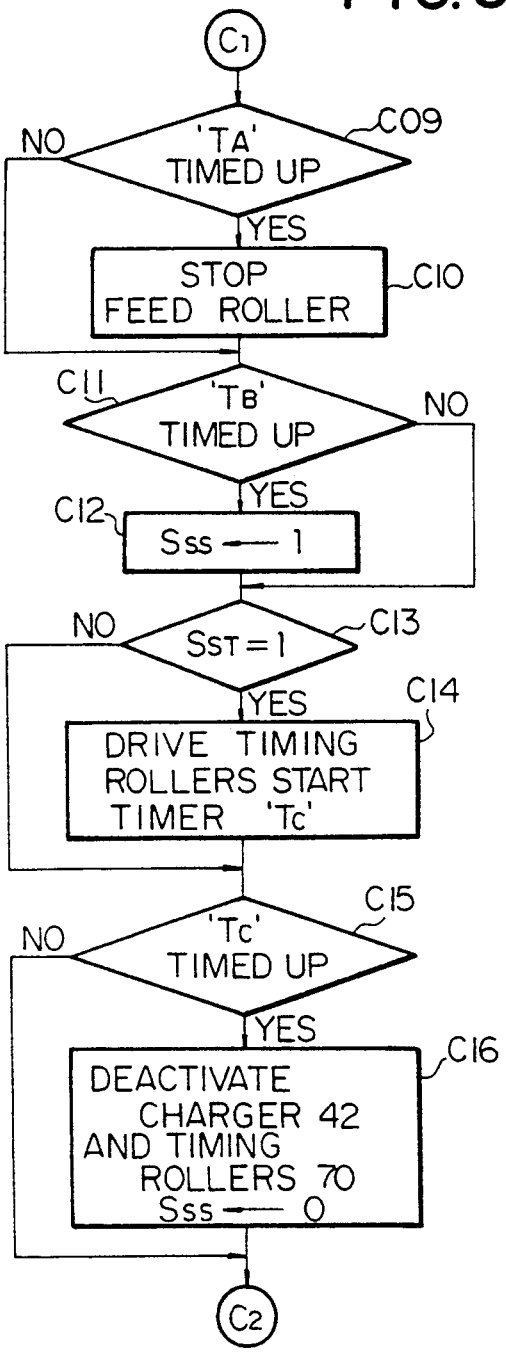
Figure 6C:
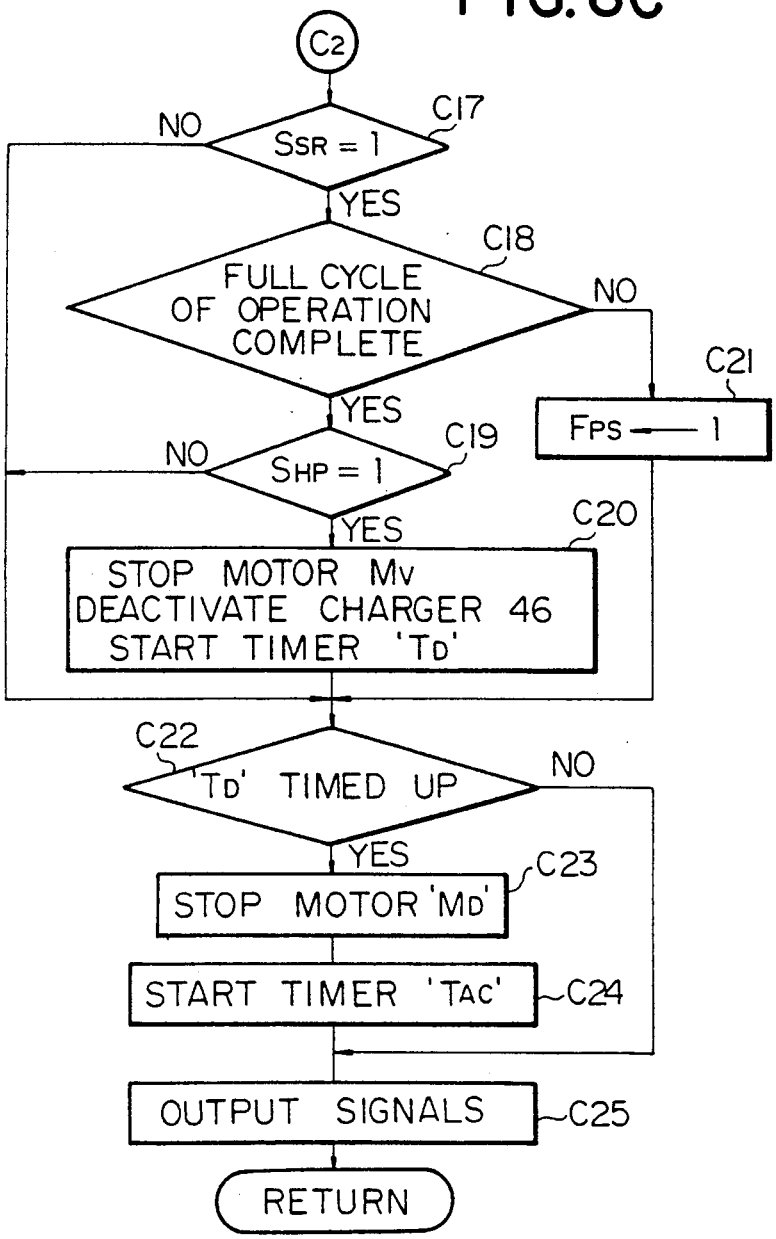

FIG. 6A, 6B and 6C show the details of a preferred example of the copying operation control subroutine program A04 included in the main routine program hereinbefore described with reference to FIG. 4.

As shown in FIG. 6A, the copying operation control subroutine program A04 starts with a decision step C01 to determine whether or not there is a signal produced with the print start switch 102 depressed. If it is found at this step C01 that this is the case, a print-start flag $F_{PS}$ of logic "1" state is set at step C02 to indicate that a cycle copying operation may be started. Subsequently to this step C02 or if it is found at the step C01 that there is no signal produced with the print start switch 102 depressed, it is further questioned at a decision step C03 whether or not there is a print-start flag $F_{PS}$ of logic "1" state. If it is found at this step C03 that there is present the print-start flag $F_{PS}$ of logic "1" state, then the print-start flag $F_{PS}$ is reset to logic "0" state as at step C04 and the control unit 200 outputs signals to start the various driver and actuator means included in or associated with the image reproducing system 16. These driver and actuator means may include the driver means for the main and developer drive motors 40 and 45, the actuator means for the main charger 42 and so on. In addition, first and second system timers, "$T_A$" and "$T_B$", included in the control unit 200 are activated to start counting operation. By the first system timer "$T_A$" is prescribed the timing at which the solenoid-operated clutch for the paper feed roller 62 or 64 associated with the lower or upper print-sheet supply cassette 58 or 60, respectively, is to be de-energized. By the second system timer "$T_B$" is prescribed the timing at which the document scanner 22/24 is to be initiated into motion to scan the document sheet placed on the document support table 12.

The step C04 is followed by a decision step C05 at which is detected whether or not the lower print-sheet supply cassette 58 has been selected for use in the cycle of operation started. If it is found at this step C05 that this is the case, the control unit 200 outputs a signal at step C06 to actuate the clutch for the paper feed roller 62 associated with the lower print-sheet supply cassette 58. If it is determined at the step C05 that the lower print-sheet supply cassette 58 has not been selected for use, it is checked at another decision step C07 whether or not the upper print-sheet supply cassette 60 has been selected for use. If the answer for this step C07 is given in the affirmative, the control unit 200 outputs a signal at step C08 to actuate the clutch for the paper feed roller 64 associated with the upper print-sheet supply cassette 60.

Subsequently to the step C06 or step C08 or if it is found at the step C03 that there is present no print-ready flag $F_{PR}$ of logic "1" state or at step C07 that the upper print-sheet supply cassette 60 has not been selected, it is tested at step C09 (FIG. 6B) whether or not the first system timer "$T_A$" has terminated its counting operation. When the answer for this decision step C09 is given in the affirmative, the control unit 200 outputs at step C10 a signal to de-activate the clutch for the paper feed roller 62 or 64 associated with the selected print-sheet supply cassette 58 or 60. Subsequently to this step C10 or when it is determined at step C09 that the system timer "$T_A$" is still in operation, it is checked at step C11 whether or not the time prescribed on the second system timer "$T_B$" has elapsed. If the answer for this step C11 is given in the affirmative, the control unit 200 outputs a scan start signal $S_{SS}$ of logic "1" state at step C12. This scan start signal $S_{SS}$ is supplied from the first control unit 200 to the second control unit 202 which, in response to the signal $S_{SS}$, outputs a signal to initiate the optical scanning system 14 into operation to scan the document sheet on the document support table 12.

Subsequently to step C12 or when it is found at step C11 that the second system timer "$T_B$" is still in operation, the control unit 200 proceeds to a decision step C13 to confirm whether or not there is present a scan timing signal $S_{ST}$ of logic "1" state. This scan timing signal $S_{ST}$ is produced by the scan timing sensor 90 provided in the optical scanning system 14 and is relayed from the second control unit 202 to the first control unit 200. When it is determined at step C13 that there is present the timing signal of logic "1" state, then the first control unit 200 outputs at step C14 a signal to energize the clutch for the timing rollers 70. The timing rollers 70 are now driven for rotation so that the print sheet which has been supplied from the print-sheet supply cassette 58 or 60 is allowed to travel past the timing rollers 70 into contact with the image transfer drum 38. The toner particles which have been applied to the peripheral surface of the image transfer drum 38 are transferred to the surface of the copy sheet by means of the image transfer charger 46. At this step C14 is further started a third system timer, "$T_C$", which dictates the timing at which the scanning operation is to be terminated, the timing at which the drive means for the chargers 42, 46 and 48 are to be de-energized, and the timing at which the clutch for the timing rollers 70 is to be de-energized. It is then tested at a decision step C15 whether or not the timing preset by the third system timer "$T_C$" has been reached. If the answer for this step C15 is given in the affirmative, the control unit 200 outputs at step C16 signals to de-activate the drive means for the main charger 42 and the clutch for the timing rollers 70. In addition, the scan start signal $S_{SS}$ is reset to logic "0" state at this step C16.

Subsequently to step C16 or when it is determined at step C15 that the timing dictated by the system timer "$T_C$" has not yet been reached, the control unit 200 proceeds to a decision step C17 (FIG. 6C) to detect whether or not there is present a scanner return signal $S_{SR}$ of logic "1" state supplied from the second control unit 202. If the document scanner 22/24 is on the way back to its home position so that the scanner return signal $S_{SR}$ is of logic "1" state, it is further tested at a decision step C18 whether or not a full cycle of copying operation is complete with a required number of printing steps repeated. If it is found at step C18 that this is the case, then it is further tested at step C19 whether or not the document scanner 22/24 has reached its initial home position. This test is made on the basis of the signal $S_{HP}$ produced by the home position sensor 88 and supplied to the control unit 200 from the second microprocessor 202. In the presence of the signal $S_{HP}$ of logic "1" state so that the answer for step C19 is given in the affirmative, the control unit 200 outputs at step C20 a signal to bring the developer drive motor 45 and de-activate the drive means for the image transfer charger 46. At step C20 is further started a fourth system timer, "$T_D$", which dictates the timing at which the main drive motor 40 is to be brought to a stop.

If it is found at the previous step C18 that the full cycle of copying operation is complete with the designated number of printing steps repeated, the step C18 is followed by step C21 at which the print-start flag $F_{PS}$ is set to logic "1" state for a second time. Subsequently to the step C20 or step C21 or if it is determined at step C17 that the scanner return signal $S_{SR}$ is of logic "0" state or at step C19 that the document scanner 22/24 has not yet reached its initial home position, the control unit 200 proceeds to step C22 to detect whether or not the time interval set on the fourth system timer "$T_D$" has elapsed. If it is found at this step C22 that the time interval set on the fourth system timer "$T_D$" has elapsed, the control unit 200 outputs at step C23 a signal to bring the main drive motor 40 to a stop. The step C23 is followed by step C24 at which the automatic clear timer $T_{AC}$ is activated to start counting operation. At subsequent step C25, the control unit 200 outputs signals to be supplied to appropriate external devices. Upon completion of the process step C25, the first control unit 200 returns to the main routine program of FIG. 4 and may proceed to the IC-card controlled mode select control subroutine program A05 to be hereinafter described with reference to FIGS. 7A to 7D.

IC-Card Optional Mode Select Subroutine (A05)

FIG. 7A, 7B, 7C and 7D show the details of a preferred example of the IC-card controlled mode select control subroutine program A05 included in the main routine program hereinbefore described with reference to FIG. 4. Through execution of this IC-card controlled mode select control subroutine program A05, either the standard conditions for copying operation determined in accordance with the default rules incorporated in the control unit 200 or the IC-card optional conditions for copying operation determined in accordance with the data stored in an IC card 210 are established in the duplicating apparatus.

Figure 7A:
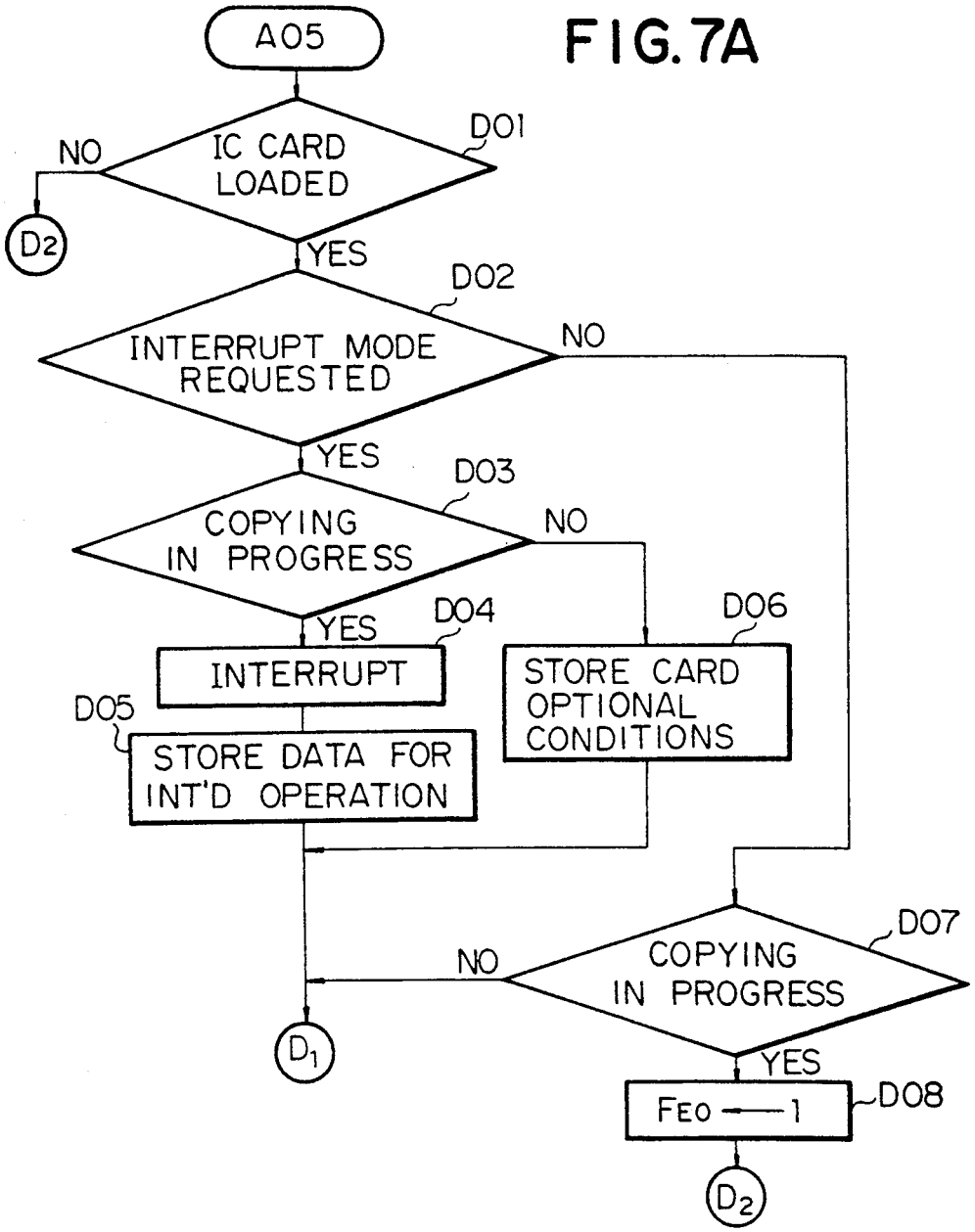
FIG. 7A, 7B, 7C and 7D are flowcharts showing the details of an IC-card controlled mode select control subroutine program included in the main routine program illustrated in FIG. 4.
Figure 7B:
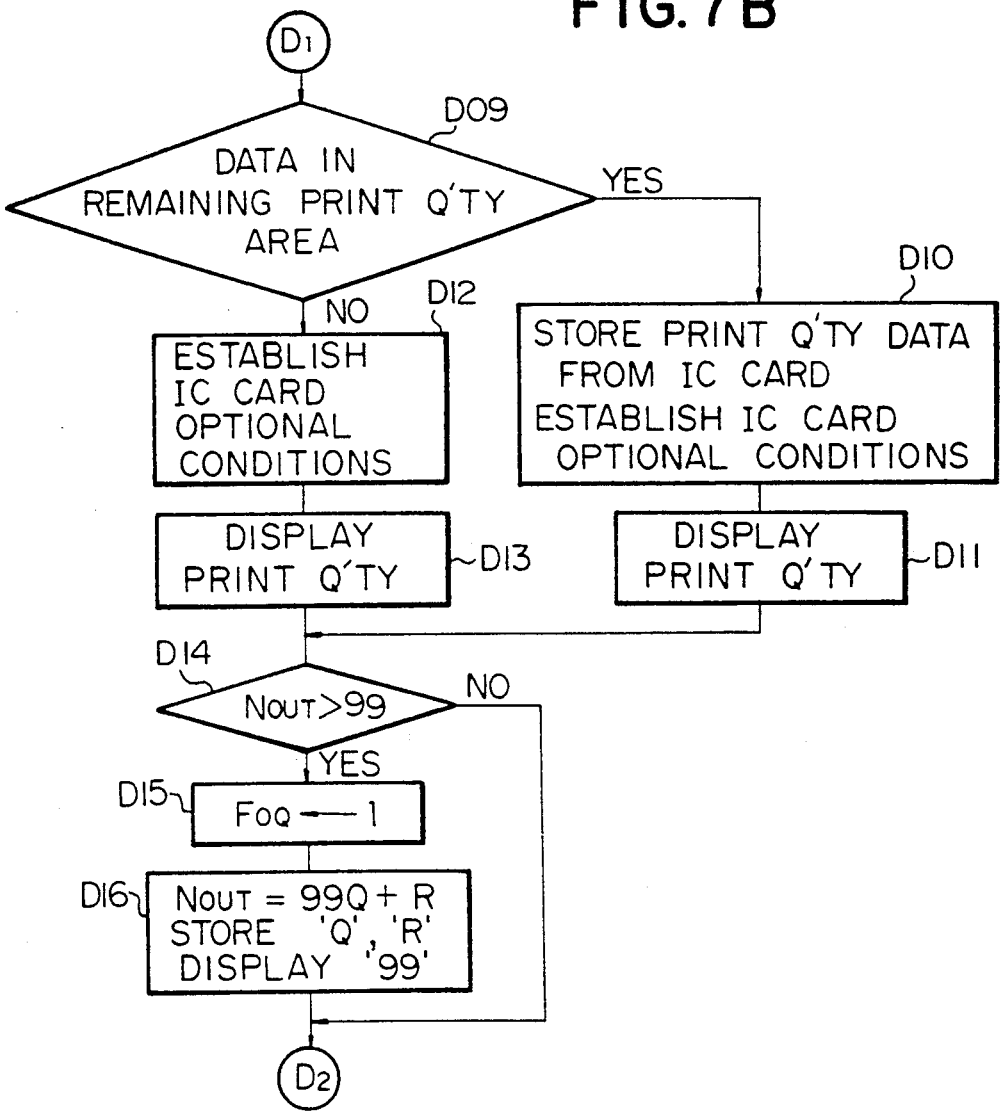

Referring to FIG. 7A, such an IC-card controlled mode select control subroutine program A05 starts with a decision step D01 to detect whether or not the IC card 210 is loaded into the control panel 100 through the IC card insertion slot 128 provided in the panel 100. If the answer for this step D01 is given in the affirmative, it is further tested at step D02 whether or not an interrupt mode of copying operation is currently requested by the data read from the IC card 210 set in the control panel 100. If the answer for this step D02 is also given in the affirmative, it is further tested at step D03 whether or not a cycle of copying operation is currently in progress. If it is found that this is the case, the control unit 200 outputs a signal to interrupt the cycle of copying operation currently in progress as at step D04 and thereupon the data representative of the conditions for copying operation which have been selected for the cycle of operation interrupted is provisionally stored into the random-access memory 212 annexed to the control unit 200 as at step D05.

If it is determined at step D03 that there is no cycle of copying operation currently in progress, the step D03 is followed by step D06 at which the data representative of the conditions for copying operation which are currently established in the duplicating apparatus is stored into the random-access memory 212 associated with the control unit 200. If it is found at step D02 that there currently is no request from the control panel 100 for an interrupt mode of copying operation, it is checked at step D07 whether or not a cycle of copying operation is currently in progress. If the answer for this step D07 is given in the affirmative, an end-of-operation wait flag $F_{EO}$ of logic "1" state is raised at step D08.

If the answer for the decision step D07 is given in the negative or subsequently to the step D05 or step D06, the control unit 200 proceeds to steps D09 to D16 (FIG. 7B) to establish in the duplicating apparatus the IC-card optional conditions for copying operation determined in accordance with the data stored in the IC card 210 set in the control panel 100. For this purpose, it is first detected at step D09 whether or not there is stored in a particular memory area (hereinafter referred to as "remaining print quantity memory area") of the IC card 210 data indicating the quantity of the printed outputs which are to be further produced If it is found that there is such data in the remaining print quantity memory area of the IC card 210, the step D09 is followed by step D10 at which the control unit 200 loads the particular data into a register incorporated in the control unit 200 and outputs signals to establish the IC-card optional conditions of copying in the apparatus in accordance with the data further stored in the IC card 210. These IC-card optional conditions of copying may include the magnification ratio, the size of the print sheets to be used, and the exposure volume to produce the designated print density. The step D10 is followed by a step D11 at which the control unit 200 outputs a signal on the basis of which the quantity of the printed outputs which remain to be produced is visually indicated on the numerical display window 106 on the control panel 100.

If it is found at step D09 that data indicating the quantity of the printed outputs to be further produced is not stored in the remaining print quantity memory area of the IC card 210, then the step D09 is followed by step D12 at which the control unit 200 outputs a signal to establish the IC-card optional conditions of copying in the apparatus in accordance with the data stored in the IC card 210. These IC-card optional conditions of copying may include the quantity of the printed outputs to be produced, the magnification ratio, the size of the print sheets to be used, and the exposure volume to produce the designated print density. The step D12 is followed by a step D13 at which the control unit 200 outputs a signal on the basis of which the quantity of the printed outputs which are to be produced is visually indicated on the numerical display window 106.

Subsequently to the step D11 or step D13, it is checked at step D14 whether or not the required quantity $N_{OUT}$ of printed outputs is larger than 99 which is assumed to be the maximum quantity of printed outputs which can be produced by a single cycle of copying operation. If the answer for this decision step D14 is given in the affirmative, the over-quantity flag $F_{OQ}$ of logic "1" state is raised at step D15, followed by a step D16 to process the data read from the IC card 210 to establish conditions allowing uninterrupted production of more than 99 printed outputs. At this step D16, the required quantity $N_{OUT}$ of printed outputs is divided by numerical value 99, thus $N_{OUT}=99Q+R$ where Q and R are the quotient and remainder, respectively, of the divisional calculation. The data representative of the quotient Q is stored into the memory area $M_Q$ of the random-access memory 212 and the data representative of the remainder R, if any, of the divisional calculation is stored into the memory area $M_R$ of the random-access memory 212 connected to the control unit 200. At this step D16, the control unit 200 further outputs a signal to visually indicate the two-digit numerical value 99 on the numerical display window 106.

Figure 7C:
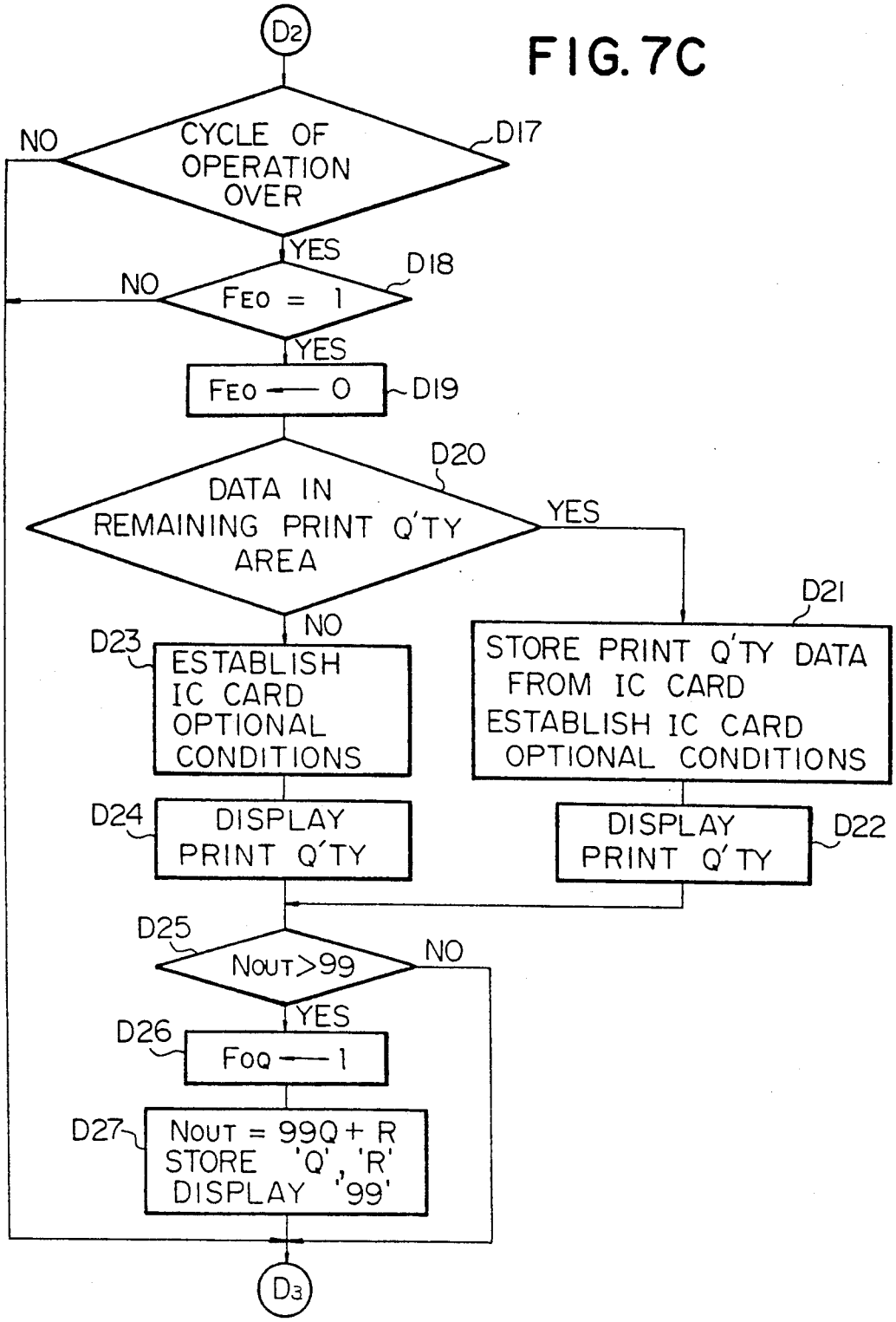

Subsequently to the step D08 or step D16 or when it is determined at step D01 that there is no IC card loaded into the control panel 100 or at step D14 that the required quantity $N_{OUT}$ of printed outputs is not larger than 99, the control unit 200 proceeds to steps D17 to D27 shown in FIG. 7C. These steps D17 to D27 are executed so that, when an interrupt mode of copying operation is requested by the data read from the IC card 210, the IC-card optional conditions selected on the basis of the data are to be established in the apparatus with a certain amount of delay after the IC card 210 has been loaded into the control panel 100.

For this purpose, it is first detected at step D17 whether or not the cycle of copying operation which has been detected to be in progress is terminated. If the answer for this decision step D17 is given in the affirmative, it is checked at step D18 whether or not the end-of-operation wait flag $F_{EO}$ of logic "1" state is set. If it is determined that the flag $F_{EO}$ is of logic "1" state, the flag $F_{EO}$ is reset to logic "0" state at step D19 and thereafter it is confirmed at step D20 whether or not there is stored in the remaining print quantity memory area of the IC card 210 data indicating the quantity of the printed outputs which remain to be produced. If it is found at step D20 that there is such data in the remaining print quantity memory area of the IC card 210, the step D20 is followed by step D21 at which the control unit 200 loads the particular data into a register incorporated in the control unit 200 and outputs signals to establish the IC-card optional conditions of copying in accordance with the data further stored in the IC card 210. These IC-card optional conditions of copying may include the magnification ratio, the size of the print sheets to be used, and the exposure volume to produce the designated print density. The step D21 is followed by a step D22 at which the control unit 200 outputs a signal on the basis of which the quantity of the printed outputs which remain to be produced is visually indicated on the numerical display window 106 on the control panel 100.

If it is found at step D20 that data indicating the quantity of the printed outputs to be further produced is not stored in the remaining print quantity memory area of the IC card 210, then the step D20 is followed by step D23 at which the control unit 200 outputs a signal to establish the IC-card optional conditions of copying in the apparatus in accordance with the data stored in the IC card 210. These IC-card optional conditions of copying may include the quantity of the printed outputs to be produced, the magnification ratio, the size of the print sheets to be used, and the exposure volume to produce the designated print density. The step D23 is followed by a step D24 at which the control unit 200 outputs a signal on the basis of which the quantity of the printed outputs which are to be produced is visually indicated on the numerical display window 106.

Subsequently to the step D22 or step D24, it is checked at step D25 whether or not the required quantity $N_{OUT}$ of printed outputs is larger than 99. If the answer for this decision step D25 is given in the affirmative, the over-quantity flag $F_{OQ}$ of logic "1" state is raised at step D26, followed by a step D27 to process the data from the IC card 210 as in the case of the step D16 to store the data representative of the quotient Q and remainder R of the divisional calculation $N_{OUT}=99Q+R$ into the memory areas $M_Q$ and $M_R$, respectively, of the random-access memory 212 connected to the control unit 200. At this step D27, the control unit 200 further outputs a signal to visually indicate the two-digit numerical value 99 on the display window 106.

Figure 7D:
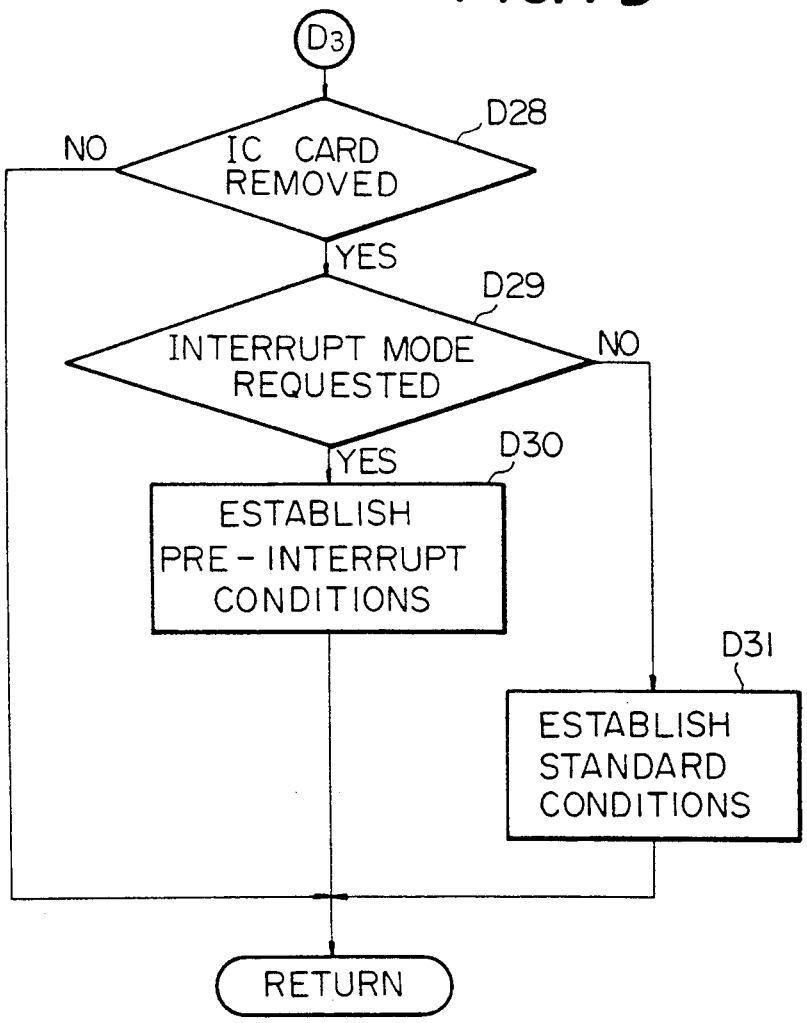

Subsequently to the step D27 or when the answer for any of the step D17, step D18 and step D25 is given in the negative, the control unit 200 proceeds to steps D28 to D31 shown in FIG. 7D. These steps D28 to D31 are executed when the IC card 210 which has been loaded into the control panel 100 is removed therefrom. When it is thus found at step D28 that the IC card 210 is removed from the control panel 100, it is tested at step D29 whether or not it has been detected (at step D02) that an interrupt mode of copying operation is requested by the data read from the IC card 210 which is now removed from the control panel 100. If the answer for this step D29 is given in the affirmative, the control unit 200 fetches the data which has been stored into the random-access memory 212 coupled to the control unit 200 at step D05 and outputs signals to establish the conditions for copying operation which have been selected for the cycle of operation interrupted. If it is found at step D29 that it has been detected (at step D02) that there is no request for an interrupt mode of copying operation from the IC card 210 now removed from the control panel 100, the step D29 is followed by step D31 at which the control unit 200 outputs signals to establish the standard conditions of copying in the apparatus in accordance with the default rules incorporated into the control unit. These standard conditions of copying may include the one-to-one magnification ratio, the A4 size of print sheets, and the exposure volume to produce the medium print density. Subsequently to step D30 or step D31 or if the answer for the step D28 is given in the negative, the control unit 200 returns to the main program and may proceed to the unacceptable function indication control subroutine program A06 to be hereinafter described with reference to FIG. 8.

Unacceptable Function Indication Control Subroutine (A06)

Figure 8:
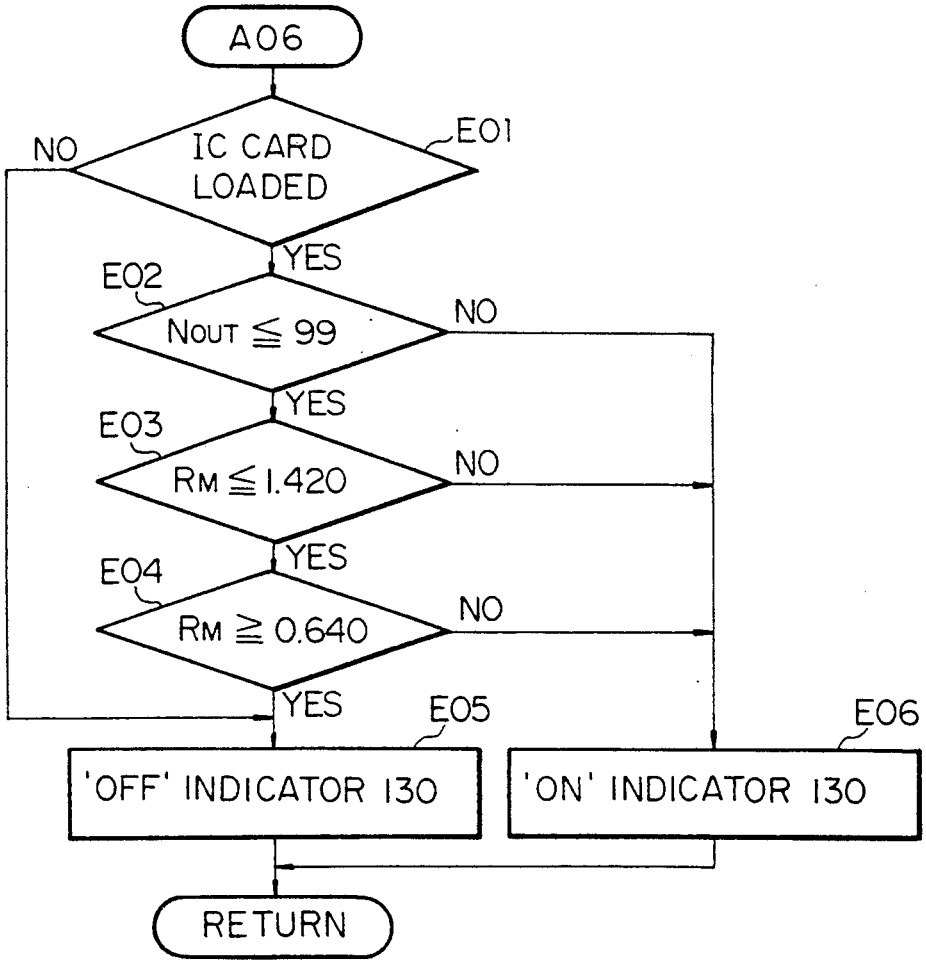
FIG. 8 is a flowchart showing the details of an unacceptable function indication control subroutine program included in the main routine program illustrated in FIG. 4.

FIG. 8 shows the details of a preferred example of the unacceptable function indication control subroutine program A06 included in the main routine program hereinbefore described with reference to FIG. 4. This unacceptable function indication control subroutine program A06 is executed to check if any of the functions required by the data stored in the IC card 210 loaded into the control panel 100 is operable in the duplicating apparatus in use and, if this is not the case, activate the unacceptable function indicator 130 to flicker.

For this purpose, it is first confirmed at step E01 whether or not there is an IC card 210 loaded into the control panel 100. If the answer for this step E01 is given in the affirmative, it is further tested at step E02 whether or not the quantity $N_{OUT}$ of printed outputs indicated by the data read from the IC card 210 is equal to or less than 99 which is assumed to be the maximum quantity of printed outputs which can be produced by a single cycle of copying operation. If the answer for this decision step E02 is given in the affirmative, then it is detected at step E03 whether or not the value of magnification ratio $R_M$ indicated by the data read from the IC card 210 is equal to or less than 1.420 which is assumed to be the maximum value of magnification ratio permissible in the duplicating apparatus under consideration. If the answer for this step E03 is given in the affirmative, the step E03 is followed by step E04 at which is checked if the value of magnification ratio $R_M$ indicated by the data read from the IC card 210 is equal to or larger than 0.640 which is assumed to be the minimum value of magnification ratio permissible in the duplicating apparatus. If the answer for this step E04 is given in the affirmative or the answer for the step E01 given in the negative, the control unit 200 outputs a signal to de-activate the unacceptable function indicator 130 to turn off. If the answer for any of the steps E02, step E03 and step E04 is given in the negative, then the control unit 200 outputs a signal to activate the unacceptable function indicator 130 to flicker at step E06. Subsequently to the step E05 or step E06, the control unit 200 returns to the main program and may proceed to the print quantity display control subroutine program A07 to be hereinafter described with reference to FIGS. 9A to 9C.

Print Quantity Display Control Subroutine (A07)

Figure 9A:
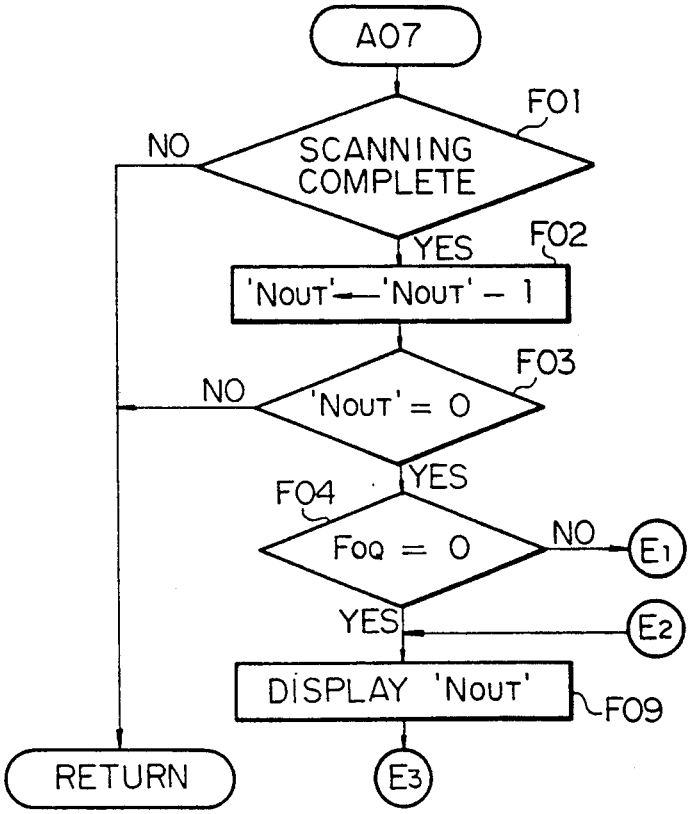
FIGS. 9A, 9B, and 9C are flowcharts showing the details of a print quantity display control subroutine program included in the main routine program illustrated in FIG. 4.
Figure 9B:
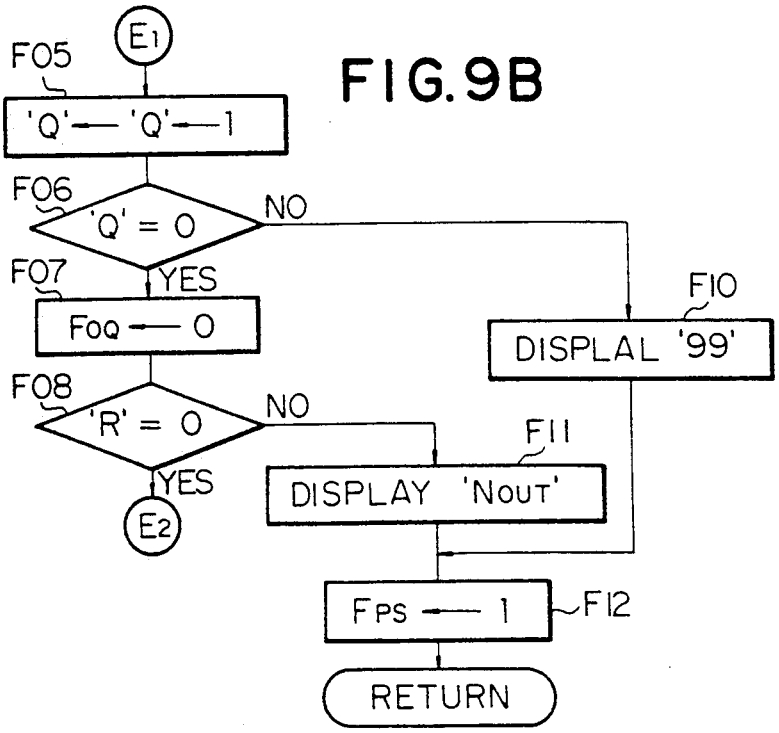
Figure 9C:
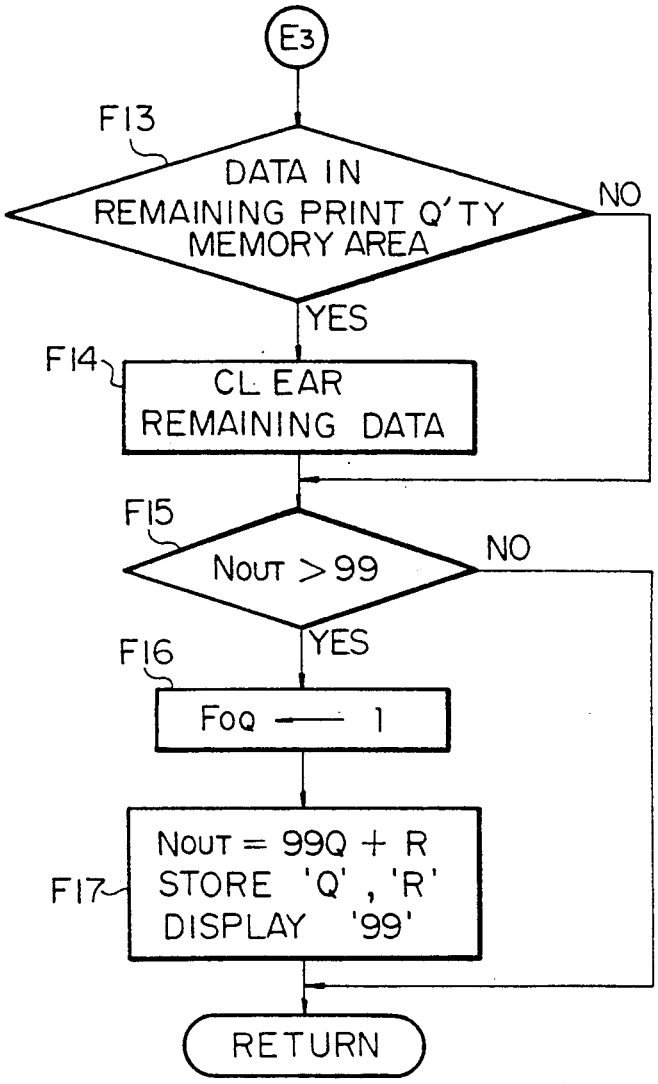

FIGS. 9A, 9B and 9C show the details of a preferred example of the print quantity display control subroutine program A07 included in the main routine program hereinbefore described with reference to FIG. 4.

This print quantity display control subroutine program A07 is executed to decrement the numerical value on the display window 106 every time a cycle of scanning operation for a document sheet is terminated or, in other words, each series of image reproducing steps is complete. Such a subroutine program A07 starts with a decision step F01 to check if a cycle of scanning operation which has once been started is terminated. This test may be made on the basis of the output signals $S_{HP}$ and $S_{ST}$ from the home position and scan start sensors 88 and 90. When it is detected at step F01 that a cycle of scanning operation which has once been started is terminated, the control unit 200 outputs at step F02 a signal to decrement the numerical value indicated on the display window 106 of the control panel 100. Subsequently to step F02, it is confirmed at step F03 whether or not the numerical value currently indicated on the display window 106 is "zero".

If the answer for this step F03 is given in the affirmative, it is further tested at step F04 whether or not the over-quantity flag $F_{OQ}$ of logic "0" state is set. As has been noted, the over-quantity flag $F_{OQ}$ is to assume a logic "1" state when the quantity $N_{OUT}$ of the printed outputs required to be produced by the data read from the IC card 210 is detected to be more than 99 which is assumed to be the maximum quantity of printed outputs which can be produced by a single cycle of copying operation. If it is found at step F05 that the over-quantity flag $F_{OQ}$ is of logic "1", the control unit 200 outputs at step F05 (FIG. 9B) a signal to decrement the numerical value stored in the memory area $M_Q$ storing the quotient "Q" of the divisional calculation $N_{OUT}=99Q+R$ performed in the IC-card controlled mode select control subroutine program A05 (FIGS. 7A to 7D). Thus, decrementing the content of the memory area $M_Q$ by one step means that 99 printed outputs have been produced.

The step F05 is followed by a decision step F06 at which is checked if the numerical value "Q" currently stored in the memory area $M_Q$ is "zero". If the answer for this step is given in the affirmative, it is determined that the quantity of the printed outputs which remain to be produced is less than 99 and, thus, the over-quantity flag $F_{OQ}$ is reset to logic "0" state at step F07. Thereupon, it is detected at step F08 whether or not the numerical value currently stored in the memory area $M_R$ storing the remainder "R" of the divisional calculation $N_{OUT}=99Q+R$ is "zero".

The affirmative answer given for this step F08 means that all the printed outputs required to be produced by the data read from the IC card 210 have been produced. On the other hand, if it is found at step F04 that the over-quantity flag $F_{OQ}$ is of a logic "0" state, it is understood that the quantity $N_{OUT}$ of the printed outputs required to be produced by the data read from the IC card 210 is less than 99. If the answer for the step F04 or step F08 is given in the affirmative, the step F04 or F08 is followed by step F09 (FIG. 9A) at which quantity $N_{OUT}$ of the printed outputs required to be produced by the data read from the IC card 210 is indicated on the numerical display window 106.

If it is found at step F06 that the numerical value "Q" currently stored in the memory area $M_Q$ is not "zero", it is determined that the quantity of the printed outputs which remain to be produced is more than 99 and, thus, the control unit 200 outputs at step F10 a signal to indicate numerical value 99 on the display window 106. On the other hand, if it is found at step F08 that the numerical value currently stored in the memory area $M_R$ is not "zero", it is determined that, with the content of the memory area $M_Q$ already decremented to "zero", at least one but less than 99 printed outputs are still required to be produced. In this instance, the control unit 200 proceeds to step F11 to indicate on the display window 106 the quantity $N_{OUT}$ of the printed outputs to be further produced.

Subsequently to the step F10 or step F11, the control unit 200 proceeds to step F12 to set the print start flag $F_{PS}$ of logic "1" state and thereafter returns to the main program described with reference to FIG. 4.

On the other hand, the step F09 is followed by steps F13 and F14 to clear the data which has been stored in the remaining print quantity memory area of the IC card 210. For this purpose, it is detected at step F13 whether or not there is stored in the remaining print quantity memory area of the IC card 210 data indicating the quantity of the printed outputs which remain are to be produced. If it is found that there is such data in the remaining print quantity memory area of the IC card 210, the step F13 is followed by step F14 at which the control unit 200 clears the particular data since there currently is no printed output required to be produced. These steps F13 and F14 are useful for enabling the control unit 200 to give a correct answer for the decision step D09 in the IC-card controlled mode select control subroutine program A05.

The step F14 is followed by a step F15 to check if the quantity $N_{OUT}$ of the printed outputs newly indicated on the numerical display window 106 at step F09 is larger than 99. If the answer for this decision step F15 is given in the affirmative, the over-quantity flag $F_{OQ}$ of logic "1" state is set at step F16, followed by a step F17 to process the data from the IC card 210 as in the case of the step D16 in the IC-card controlled mode select control subroutine program A05 to store the data representative of the quotient Q and remainder R of the divisional calculation $N_{OUT}=99Q+R$ into the memory areas $M_Q$ and $M_R$, respectively, of the random-access memory 212. At this step F17, the control unit 200 further outputs a signal to visually indicate the two-digit numerical value 99 on the display window 106.

Subsequently to the step F17, the control unit 200 returns to the main program described with reference to FIG. 4 and may proceed to the failure indication control subroutine program A08 to be described with reference to FIG. 10.

As will have been understood from the foregoing description, the print quantity display control subroutine program A07 is effective to allow uninterrupted production of more than 99 printed outputs when such a large number of printed outputs are required by the data read from the IC card 210. When the quantity $N_{OUT}$ of the printed outputs required to be produced by the data read from the IC card 210 is larger than 99, a series of 99 printing steps is repeated a number of times designated by the numerical value (Q) initially stored in the memory area $M_Q$ of the random-access memory 212 and, thereafter, a printing step is repeated a number of times designated by the numerical value (R) initially stored in the memory area $M_R$ of the memory 212.

Failure Indication Control Subroutine (A08)

Figure 10:
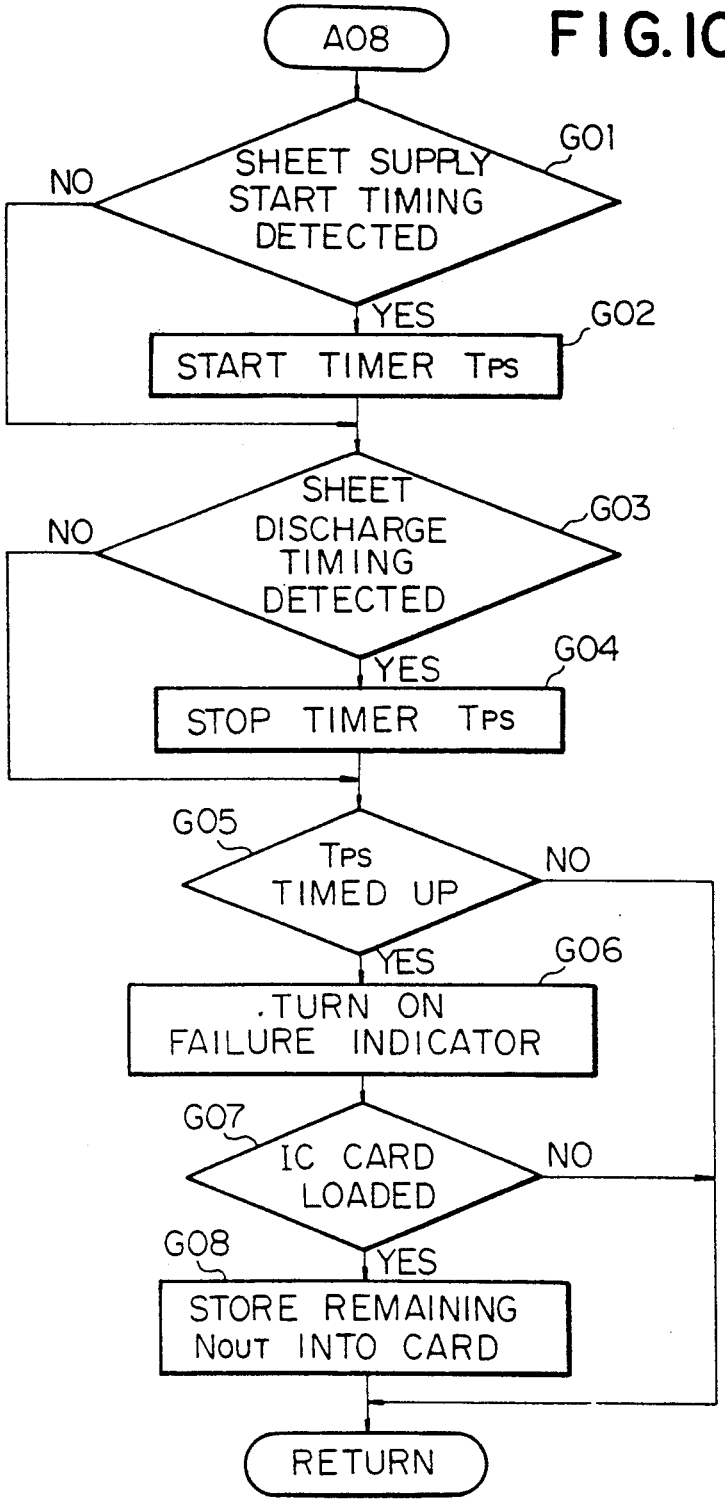
FIG. 10 is a flowchart showing the details of a failure indication control subroutine program included in the main routine program illustrated in FIG. 4.

FIG. 10 shows the details of a preferred example of the failure indication control subroutine program A08 included in the main routine program hereinbefore described with reference to FIG. 4. This failure indication control subroutine program A08 is characterized by a series of steps G01 to G05 to detect an occurrence of jamming of a print sheet within the duplicating apparatus.

Such a subroutine program A08 starts with a decision step G01 to check if a timing is detected at which the supply of a print sheet started from either the lower print-sheet supply cassette 58 or the upper print-sheet supply cassette 60. A print sheet is supplied from the cassette 58 or 60 with the clutch for the print-sheet feed roller 62 or the clutch for the print-sheet feed roller 64 actuated to drive the roller 62 or 64. When it is confirmed that such a timing is detected, a system timer $T_{PS}$ of the control unit 200 is activated at step G02 to start counting of time at the timing detected. The print sheet supplied from the lower or upper print-sheet supply cassette 58 or 60 will be passed to the image reproducing system 16 to receive toner images thereon and, after the toner images are thermally fixed, will be withdrawn from the apparatus.

After the system timer $T_{PS}$ is activated to start counting of time at step G02 or if it is determined at step G01 that the timing at which the supply of a print sheet is started is not detected, it is confirmed at step G03 whether or not the timing at which the print sheet is withdrawn from the apparatus is detected. When it is found at this step G03 that such a timing is detected, the step G03 is followed by a step G04 at which the system timer $T_{PS}$ is de-activated to cease counting of time at the timing detected at step G03. After the system timer $T_{PS}$ is de-activated to cease counting of time at step G04 or if it is determined at step G03 that the timing at which the print sheet is withdrawn is not detected, it is confirmed at step G05 whether or not the timer $T_{PS}$ has terminated its counting operation. If the answer for this decision step G05 is given in the affirmative, it is understood that jamming of the print sheet once supplied from the cassette 58 or 60 has occurred within the apparatus and, as such, the step G05 is followed by step G06 to activate the failure indicator 126 to flicker.

Subsequently to this step G06, it is checked at step G07 whether or not the IC card 210 is loaded into the control panel 100. If it is found that the IC card 210 is set in the control panel 100, the control unit 200 proceeds to step G08 at which the data indicating the quantity $N_{OUT}$ of the printed outputs which remain to be produced transferred to and stored into the remaining print quantity memory area of the IC card 210. When it is found at step G05 that the system timer $T_{PS}$ is still in operation or at step G07 that the IC card 210 is not loaded into the control panel 100, the control unit 200 returns to the main program and may proceed to the subroutine program A09.

Modified Initial Subroutine (A03)

Figure 11:
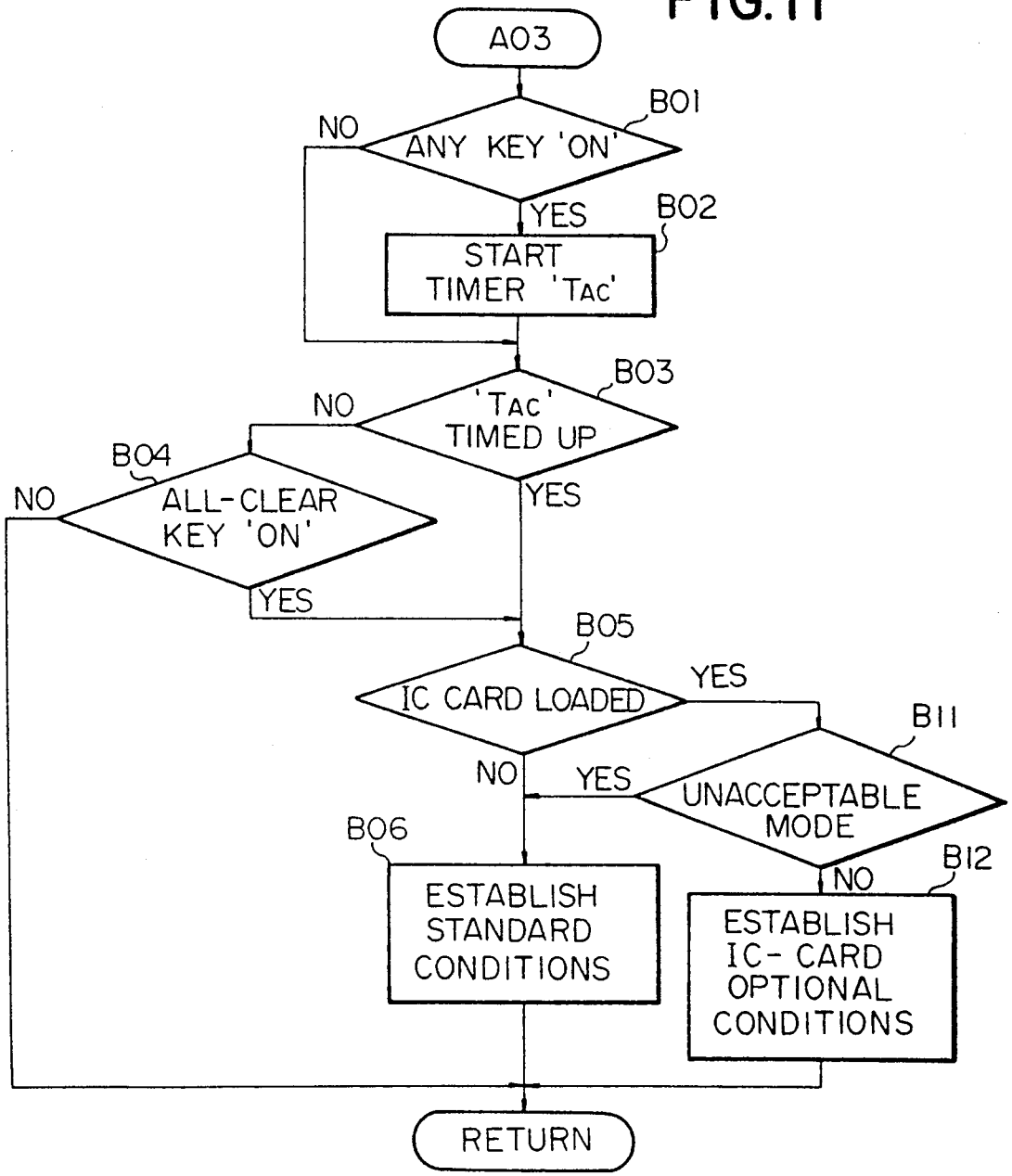
FIG. 11 is a flowchart showing a modification of the initial subroutine program illustrated in FIG. 5.

FIG. 11 shows a modification of the initial subroutine program A03 hereinbefore described with reference to FIG. 5.

On condition that any of the keys on the control panel 100 has been depressed (step B01), the automatic clear timer $T_{AC}$ is activated to start counting of time (step B02). When it is thereafter found that the automatic clear timer $T_{AC}$ has terminated the counting operation (step B03) or the all-clear key 124 has been depressed (step B04) with the counting operation of the timer $T_{AC}$ still in progress, it is detected at step B05 whether or not an IC card 210 is loaded into the control panel 100. In the absence of an IC card 210 set in the control panel 100, the control unit 200 outputs signals to establish the standard conditions for copying operation at step B06. After the standard conditions for copying operation are thus established at step B06, the control unit 200 reverts to the main routine program described with reference to FIG. 4 and may proceed to the copying operation control subroutine program A04. The subroutine program shown in FIG. 11 is similar in these steps B01 to B06 to the initial subroutine program A03 described with reference to FIG. 5.

When it is found at step B05 that there is an IC card 210 set in the control panel 100, the step B05 in the modified subroutine program herein shown is followed by a decision step B11 to check if any of the modes of operation required by the data read from the IC card 210 is unacceptable in the duplicating apparatus in use. If it is determined at this step B11 that there is no such unacceptable mode of operation required by the data stored in the IC card 210, the control unit 200 proceeds to step B12 and outputs signals to establish the IC-card optional conditions for copying operation to make the apparatus ready for producing printed outputs in accordance with the conditions indicated by the data read from the IC card. After the IC-card optional conditions for copying operation are thus established, the control unit 200 reverts to the main program as in the subroutine program A03 described with reference to FIG. 5.

On the other hand, if it is determined at step B11 that any of the modes of operation required by the data read from the IC card 210 is unacceptable in the apparatus, the IC-card optional conditions for copying operation are not established in the apparatus and, instead, the step B11 is followed by step B06 to establish the standard conditions for copying operation in the duplicating apparatus. The control unit 200 then returns to the main program and may proceed to the copying operation control subroutine program A04 described with reference to FIGS. 6A to 6C.

Modified IC-Card Optional Mode Select Subroutine (A05)

Figure 12A:
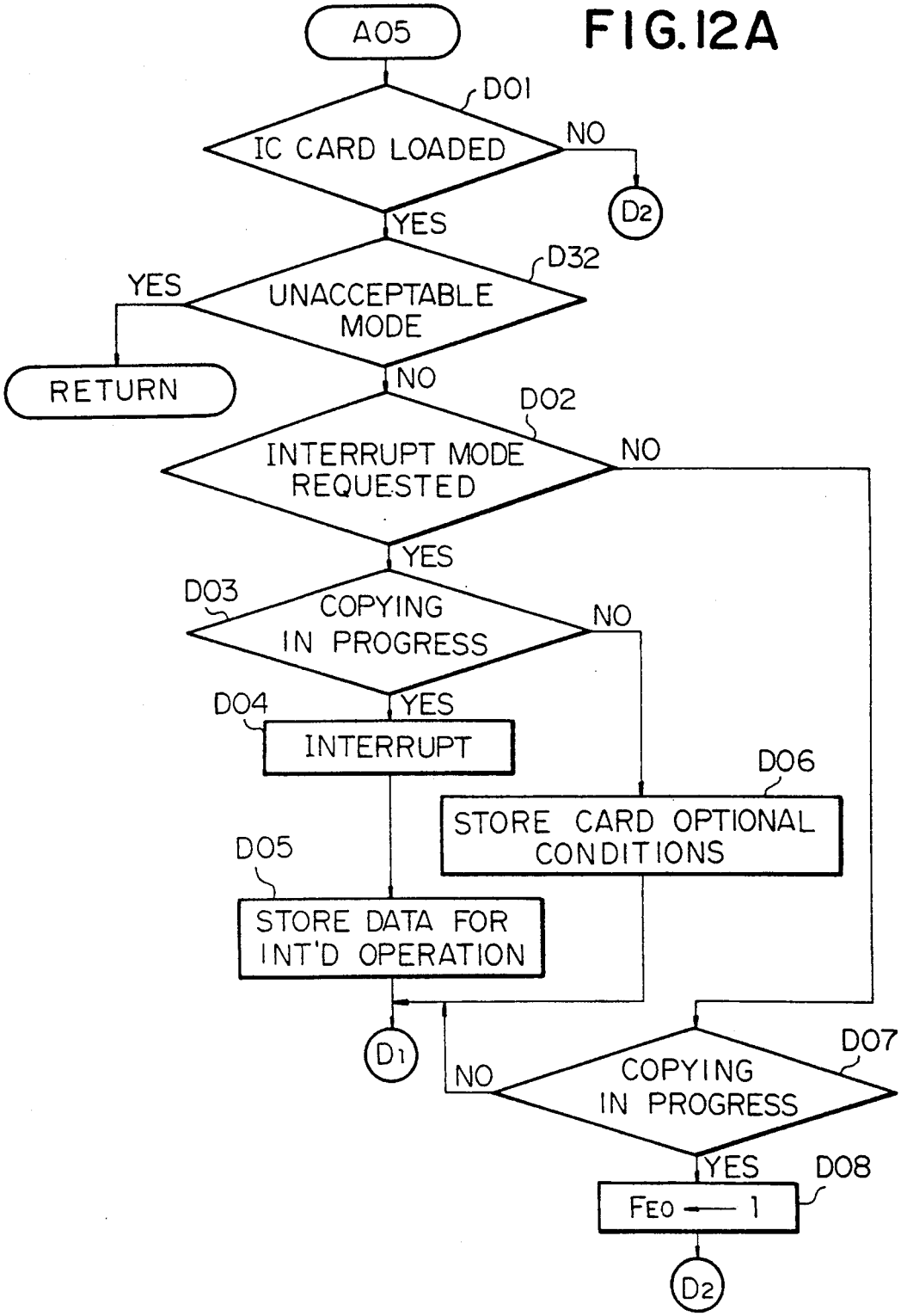
Figure 12C:
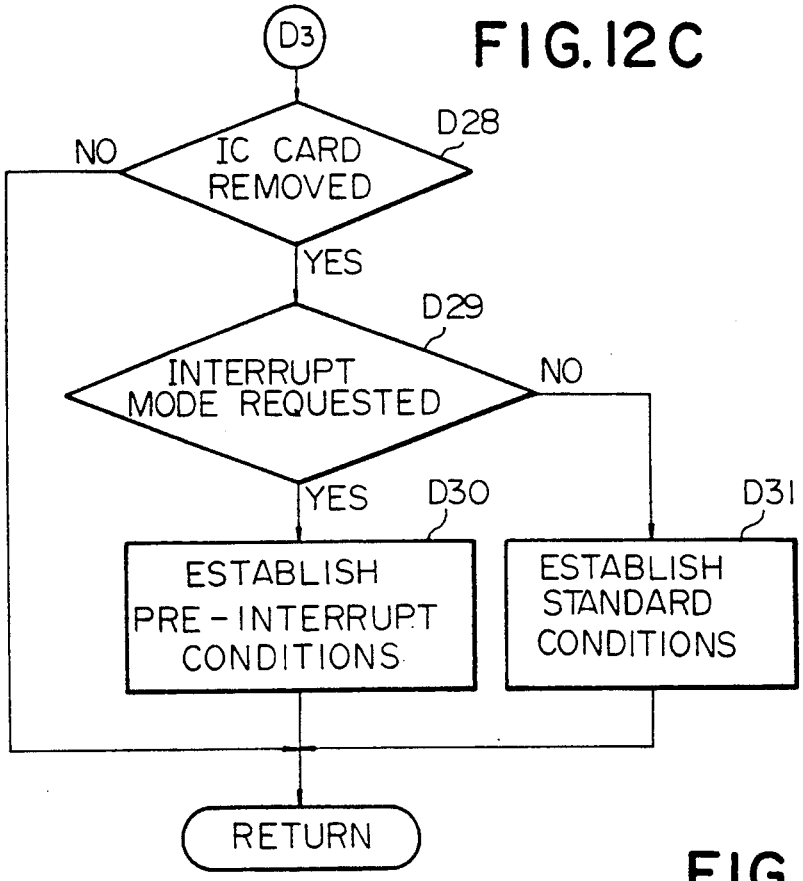

FIGS. 12A, 12B and 12C show a modification of the IC-card controlled mode select control subroutine program A05 hereinbefore described with reference to FIGS. 7A to 7D.

When it is detected that the IC card 210 is loaded into the control panel 100 (step D01) as in the subroutine program A05 described with reference to FIGS. 7A to 7D, the step D01 in this modified subroutine program is followed by step D32 to check if any of the modes of operation required by the data read from the IC card 210 is unacceptable in the duplicating apparatus in use. If it is determined at this step D32 that there is no such unacceptable mode of operation required by the data stored in the IC card 210, the control unit 200 proceeds to the block of steps D02 to D31 as in the subroutine program A05 described with reference to FIGS. 7A to 7D. The IC-card optional conditions for copying operation are thus established in the apparatus either at step D10 or at step D12 and the quantity of the printed outputs to be produced is indicated on the numerical display window 106 on the control panel 100 either at step D11 or at D13.

If there is no interrupt mode of operation requested by the data read from the IC card 210 (step D02) and the apparatus is in operation, the control unit 200 proceeds to the block of steps D17 to D24 which are similar to their respective counterparts in the subroutine program A05 described with reference to FIGS. 7A to 7D. Through this block of steps D17 to D24, the control unit 200 establishes the IC-card optional conditions of operation with a certain amount of delay after the IC card 210 has been loaded into the control panel 100. The block of these steps D17 to D24 is also followed subsequently to the step D11 or step D13 or when it is detected at step D01 that there is no IC card loaded into the control panel 100.

From the block of the steps D17 to D24, the control unit 200 proceeds to the block of steps D28 to D31 also as in the subroutine program A05 of FIGS. 7A to 7D. The control unit 200 then reverts to the main program as in the subroutine program A03 described with reference to FIG. 5 and may proceed to the unacceptable function indication control subroutine program A06.

On the other hand, if it is determined at step D32 that any of the modes of operation required by the data read from the IC card 210 is unacceptable in the apparatus, the IC-card optional conditions for copying operation are not established in the apparatus and the control unit 200 also returns to the main program and may proceed to the unacceptable function indication control subroutine program A06 described with reference to FIG. 8.

Modified Print Quantity Display Control Subroutine (A07)

Figure 13:
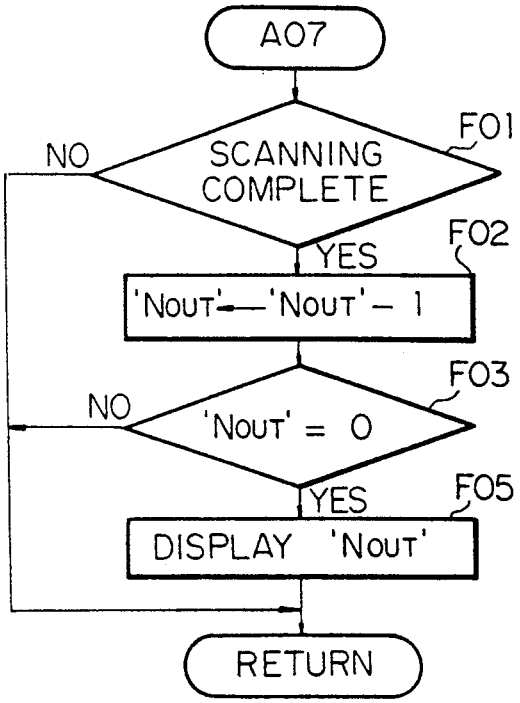
FIG. 13 is a flowchart showing a modification of the print quantity display control subroutine program illustrated in FIGS. 9A, 9B and 9C.

FIG. 13 shows a modification of the print quantity display control subroutine program A07 hereinbefore described with reference to FIGS. 9A, 9B and 9C.

This modified print quantity display control subroutine program A07 also starts with a decision step F01 to check if a cycle of scanning operation which has once been started is terminated. This test may be made on the basis of the output signals $S_{HP}$ and $S_{ST}$ from the home position and scan start sensors 88 and 90. When it is detected at step F01 that a cycle of scanning operation which has once been started is terminated, the control unit 200 outputs at step F02 a signal to decrement the numerical value indicated on the display window 106 of the control panel 100. Subsequently to step F02, it is confirmed at step F03 whether or not the numerical value currently indicated on the display window 106 is "zero".

If the answer for this step F03 is given in the affirmative, the control unit 200 proceeds directly to step F05 and outputs a signal to decrement the numerical value stored in the memory area $M_Q$ storing the quotient "Q" of the divisional calculation $N_{OUT}=99Q+R$ performed in the IC-card controlled mode select control subroutine program A05 (FIGS. 7A to 7D). Subsequently to this step F05 or when the answer for the step F01 or step F03 is given in the negative, the control unit 200 returns directly to the main program described with reference to FIG. 4 and may proceed to the failure indication control subroutine program A08 described with reference to FIG. 10.

Modified IC-Card Optional Mode Select Subroutine (A05)

Figure 14:
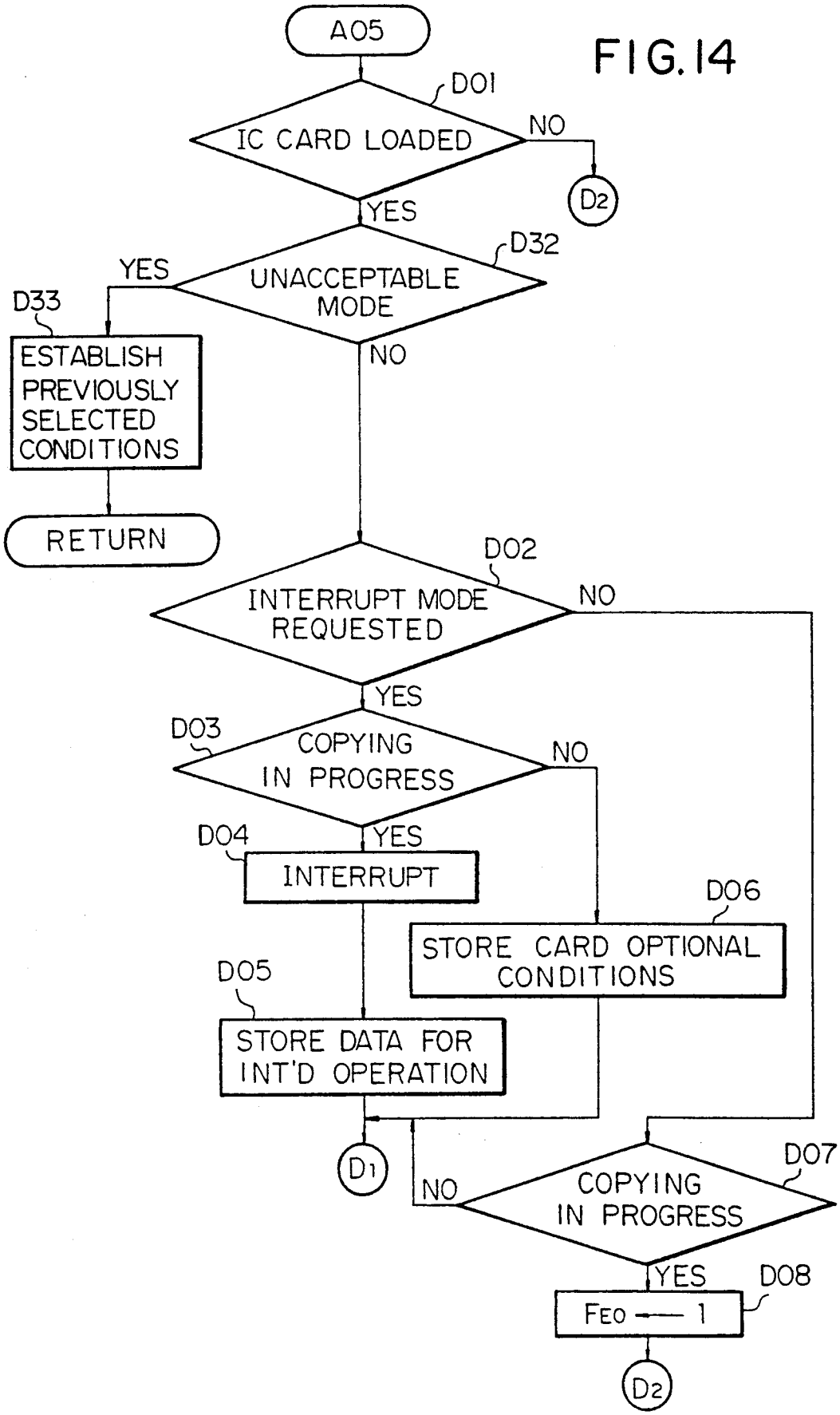
FIG. 14 is a flowchart similar to the flowchart of FIG. 12A but shows part of a further modification of the IC-card controlled mode select control subroutine program illustrated in FIG. 7A to 7D.

FIG. 14 shows part of a further modification of the IC-card controlled optional mode select control subroutine program A05 hereinbefore described with reference to FIGS. 12A to 12C.

When it is determined at step D32 in the subroutine program A05 hereinbefore described with reference to FIGS. 12A to 12C that any of the modes of operation required by the data read from the IC card 210 is unacceptable in the apparatus, the IC-card optional conditions for copying operation are not established in the apparatus and the control unit 200 returns to the main program.

In the modified IC-card controlled optional mode select control subroutine program A05 illustrated in FIG. 14, the step D32 is followed by step D33 when it is determined at step D32 that any of the modes of operation required by the data read from the IC card 210 is unacceptable in the apparatus. At this step D33, the control unit 200 is restrained from executing the steps D02 to D31 and generates an instruction to select the optional duplicating operation which had been established in the apparatus before the IC-card was set into the apparatus. The control unit 200 thereafter returns to the main program and may proceed to the unacceptable function indication control subroutine program A06 described with reference to FIG. 8.

What is claimed is:

1. An image duplicating apparatus for use with an external data storage medium storing data representative of optional conditions for duplicating operation, the apparatus having predetermined standard conditions for duplicating operation and an externally controlled mode of operation in which are to be established said optional conditions for duplicating operation on the basis of the data stored in said external data storage medium, comprising a) control means for establishing conditions for duplicating within the apparatus, b) coupling means having a first state having said external data storage medium uncoupled from said control means and a second state having said external data storage medium detachably coupled to said control means, c) detecting means for detecting each of said first and second states of said coupling means and for informing said control means of the detected state of the coupling means, and d) initial condition producing means for producing a predetermined initial condition in said control means without respect to the first and second states of said coupling means, e) said control means being responsive to said predetermined initial condition and to said first state of said coupling means for automatically establishing said standard conditions for duplicating operation within the apparatus and responsive to said predetermined initial condition and to said second state of said coupling means for automatically establishing said optional conditions for duplicating operation within the apparatus.

2. An image duplicating apparatus as set forth in claim 1, in which said initial condition producing means comprises manually operated switch means for energizing the apparatus and for producing a signal when manually operated, said initial condition producing means being operative to produce said predetermined initial condition in said control means in response to said signal.

3. An image duplicating apparatus as set forth in claim 1, in which said initial condition producing means comprises a plurality of manually operated mode select means each for producing a signal when manually operated, said initial condition producing means being operative to produce said predetermined initial condition in said control means in response to said signal.

4. An image duplicating apparatus as set forth in claim 1, in which said initial condition producing means comprises manually operated mode clear means for producing a signal when manually operated, said initial condition producing means being operative to produce said predetermined initial condition in said control means in response to said signal.

5. An image duplicating apparatus as set forth in claim 1, in which said initial condition producing means comprises timing means for producing a signal upon lapse of a predetermined period of time after any one of a plurality of manually operated mode select means is manually operated, said initial condition producing means being operative to produce said predetermined initial condition in said control means in response to said signal.

6. An image duplicating apparatus as set forth in claim 1, in which said initial condition producing means comprises d/1) manually operated switch means for energizing the apparatus and for producing a first signal when manually operated, d/2) a plurality of manually operated mode select means each for producing a second signal when manually operated, d/3) manually operated mode clear means for producing a third signal when manually operated, and d/4) timing means for producing a fourth signal upon lapse of a predetermined period of time after any one of said plurality of manually operated mode select means is manually operated, wherein said initial condition producing means is operative to produce said predetermined initial condition in said control means in response to any of said first, second, third and fourth signals.

7. An image duplicating apparatus for use with an external data storage medium storing data representative of optional conditions for duplicating operation, the apparatus being capable of producing a predetermined maximum quantity of printed outputs during a single cycle of duplicating operation and having an externally controlled mode of operation in which are to be established said optional conditions for duplicating operation on the basis of the data stored in said external data storage medium, the data stored in said external data storage medium including a printed output quantity data indicating the quantity of printed outputs to be produced during a single cycle of duplicating operation of the apparatus, comprising a) control means operative to establish conditions for duplicating within the apparatus, b) coupling means for detachably coupling said external data storage medium to said control means, and c) memory means for storing data fetched from said external data storage medium through said coupling means, d) said control means being further operative to deduct said predetermined maximum quantity of printed outputs from the quantity of printed outputs indicated by said output quantity data currently stored in said memory means each time the predetermined maximum quantity of printed outputs is produced by the apparatus, update the stored output quantity data in said memory means each time said predetermined maximum quantity of printed outputs is deducted from the quantity of printed outputs indicated by the output quantity data until the output quantity data stored in the memory means is indicative of a quantity of printed outputs less than said predetermined maximum quantity of printed outputs, and decrement the stored output quantity data in said memory means each time a printed output is produced by the apparatus until the output quantity data is indicative of no printed output remaining to be produced after the output quantity data in the memory means indicated the quantity of printed outputs less than said predetermined maximum quantity.

8. An image duplicating apparatus as set forth in claim 7, further comprising display means for visually indicating a numerical value of said predetermined maximum quantity when the quantity of printed outputs indicated by the output quantity data stored in said memory means is larger than the predetermined maximum quantity and a numerical value of the quantity of the printed outputs remaining to be produced when the quantity of printed outputs indicated by the output quantity data stored in said memory means is less than said predetermined maximum quantity.

9. An image duplicating apparatus for use with an external data storage medium storing data representative of optional conditions for duplicating operation, the apparatus being capable of producing a predetermined maximum quantity of printed outputs during a single cycle of duplicating operation and having an externally controlled mode of operation in which are to be established said optional conditions for duplicating operation on the basis of the data stored in said external data storage medium, the data stored in said external data storage medium including an output quantity data indicating the quantity of printed outputs to be produced during a single cycle of duplicating operation of the apparatus, comprising a) control means operative to establish conditions for duplicating within the apparatus, b) coupling means for detachably coupling said external data storage medium to said control means, and c) memory means for storing data fetched from said external data storage medium through said coupling means, the memory means having a first memory area and a second memory area, d) said control means being further operative to divide by said predetermined maximum quantity of printed outputs the quantity of printed outputs indicated by said output quantity data currently stored in said memory means, store the numerical value of the quotient of the divisional calculation into the first memory area of said memory means and the numerical value of the remainder of the divisional calculation into said second memory area of the memory means, update the numerical value stored in the first memory area of said memory means each time said predetermined maximum quantity of printed outputs is produced by the apparatus until the numerical value in the first memory area of the memory means is indicative of zero, and decrement the numerical value stored in the second memory area of said memory means each time a printed output is produced by the apparatus until the numerical value in the second memory area of the memory means is indicative of zero after the numerical value in said first memory area of the memory means indicated the quantity of printed outputs less than said predetermined maximum quantity.

10. An image duplicating apparatus as set forth in claim 9, further comprising display means for visually indicating a numerical value of said predetermined maximum quantity when the numerical value stored in said first memory area of said memory means is larger than zero and a numerical value equal to the numerical value stored in said second memory area of said memory means when the numerical value stored in said first memory area of said memory means indicates zero.

11. An image duplicating apparatus for use with an external data storage medium storing data representative of optional conditions for duplicating operation, the apparatus having a multiplicity of duplicating conditions which can be selectively executed and which include predetermined standard conditions for duplicating operation, the apparatus further having an externally controlled mode of operation in which are to be established said optional conditions for duplicating operation on the basis of the data stored in said external data storage medium, comprising a) control means for establishing conditions for duplicating within the apparatus, b) coupling means having a first state having said external data storage medium uncoupled from said control means and a second state having said external data storage medium detachably coupled to said control means, c) detecting means for detecting each of said first and second states of said coupling means and for informing said control means of the detected state of the coupling means, and d) initial condition producing means for producing a predetermined initial condition in said control means without respect to the first and second states of said coupling means, e) said control means being responsive to said predetermined initial condition and to said first state of said coupling means for automatically establishing said standard conditions for duplicating operation within the apparatus and responsive to said predetermined initial condition and to said second state of said coupling means for automatically establishing said optional conditions for duplicating operation within the apparatus f) said control means being further operative to detect whether or not each of the optional conditions for duplicating operation represented by the data stored in said memory means falls within the range of the multiplicity of duplicating conditions which can be executed by the apparatus, and produce a signal when it is detected that any of the optional conditions for duplicating operation represented by the data stored in said memory means falls out of said range of the multiplicity of duplicating conditions, and g) signal generating means responsive to said signal for generating a physically perceptible signal.

12. An image duplicating apparatus as set forth in claim 11, in which said control means is also operative to establish said standard conditions for duplicating operation within the apparatus when it is detected that any of the optional conditions for duplicating operation represented by the data stored in said memory means falls out of said range of the multiplicity of duplicating conditions.

13. An image duplicating apparatus as set forth in claim 11, in which said initial condition producing means comprises manually operated switch means for energizing the apparatus and for producing a signal when manually operated, said initial condition producing means being operative to produce said predetermined initial condition in said control means in response to said signal.

14. An image duplicating apparatus as set forth in claim 11, in which said initial condition producing means comprises a plurality of manually operated mode select means each for producing a signal when manually operated, said initial condition producing means being operative to produce said predetermined initial condition in said control means in response to said signal.

15. An image duplicating apparatus as set forth in claim 11, in which said initial condition producing means comprises manually operated mode clear means for producing a signal when manually operated, said initial condition producing means being operative to produce said predetermined initial condition in said control means in response to said signal.

16. An image duplicating apparatus as set forth in claim 11, in which said initial condition producing means comprises timing means for producing a signal upon lapse of a predetermined period of time after any one of a plurality of manually operated mode select means is manually operated, said initial condition producing means being operative to produce said predetermined initial condition in said control means in response to said signal.

17. An image duplicating apparatus as set forth in claim 11, in which said initial condition producing means comprises d/1) manually operated switch means for energizing the apparatus and for producing a first signal when manually operated, d/2) a plurality of manually operated mode select means each for producing a second signal when manually operated, d/3) manually operated mode clear means for producing a third signal when manually operated, and d/4) timing means for producing a fourth signal upon lapse of a predetermined period of time after any one of said plurality of manually operated mode select means is manually operated, wherein said initial condition producing means is operative to produce said predetermined initial condition in said control means in response to any of said first, second, third and fourth signals.

18. An image duplicating apparatus for use with an external data storage medium storing data representative of optional conditions for duplicating operation, said external data storage medium having a memory area for storing therein updatable output quantity data initially indicating the quantity of printed outputs to be produced during a single cycle of duplicating operation, the apparatus having an externally controlled mode of operation in which are to be established said optional conditions for duplicating operation on the basis of the data stored in said external data storage medium, comprising a) control means operative to establish conditions for duplicating within the apparatus, b) coupling means for detachably coupling said external data storage medium to said control means, c) memory means for storing data fetched from said external data storage medium through said coupling means, and d) detecting means responsive to an occurrence of a failure in the apparatus for producing a signal indicative of the occurrence of the failure detected, e) said control means being further operative to update the output quantity data in said memory means each time a printed output is produced by the apparatus, and update the output quantity data in said memory area of said external data storage medium data in accordance with the current output quantity data in said memory means in response to said signal from said detecting means.

19. An image duplicating apparatus for use with an external data storage medium storing data representative of optional conditions for duplicating operation, the apparatus having a multiplicity of duplicating conditions which can be selectively executed, the apparatus further having an externally controlled mode of operation in which are to be established said optional conditions for duplicating operation on the basis of the data stored in said external data storage medium and an interrupt mode of operation allowing interruption of a cycle of duplicating operation currently in progress, comprising a) control means for selecting any ones of said multiplicity of duplicating conditions and for establishing the selected duplicating conditions within the apparatus, b) memory means for storing data representative of the duplicating conditions selected by said control means or the data fetched from said external data storage medium c) coupling means having a first state having said external data storage medium uncoupled from said control means and a second state having said external data storage medium detachably coupled to said control means, d) detecting means for detecting each of said first and second states of said coupling means and for informing said control means of the detected state of the coupling means, e) memory means for storing data representative of the duplicating conditions selected by said control means in response to said first state of said coupling means and the data fetched from said external data storage medium through said coupling means in response to said second state of said coupling means, f) said control means being responsive to transition from said second state to said first state of said coupling means for updating the data in said memory means with the data representative of the duplicating conditions which have been established prior to said transition from said second state to said first state, and establishing said optional conditions for duplicating operation within the apparatus, and being responsive to transition from said first state to said second state of said coupling means for establishing said duplicating conditions represented by the data in said memory means updated in response to said transition from said second state to said first state.

20. An image duplicating apparatus for use with an external data storage medium storing data representative of optional duplicating conditions, the apparatus having a multiplicity of duplicating conditions which can be selectively executed, the apparatus further having an externally controlled mode of operation in which are to be established said optional duplicating conditions for duplicating operation on the basis of the data stored in said external data storage medium, comprising a) control means operative to establish conditions for duplicating within the apparatus, b) coupling means for detachably coupling said external data storage medium to said control means, and c) judging means for judging whether or not a particular one of said optional duplicating conditions is acceptable in the apparatus and, when it is judged that the particular one of said optional duplicating conditions is not acceptable, prompting said control means to establish the optional duplicating condition which had been selected before said external data storage medium was coupled to said control means.

* * * * *

UNITED STATES PATENT AND TRADEMARK OFFICE

CERTIFICATE OF CORRECTION

PATENT NO. : 5,278,611

DATED : January 11, 1994

INVENTOR(S) : Masazumi Ito, et al.

It is certified that error appears in the above-indentified patent and that said Letters Patent is hereby corrected as shown below:

On the Title Page, left-hand column, in the first line of item "[63]", change "Nov. 24, 1989," to --Oct. 24, 1989--.

On the Title page, right-hand column, in line 12 of the Abstract paragraph, change "responses" to --response--.

In col. 9, line 62, change "2/24" to --22/24--.

Signed and Sealed this

Twenty-third Day of August, 1994

Bruce Lehman

*Attest:*

BRUCE LEHMAN

*Attesting Officer*

*Commissioner of Patents and Trademarks*